US008875418B2

(12) United States Patent
Long

(10) Patent No.: US 8,875,418 B2
(45) Date of Patent: Nov. 4, 2014

(54) TENDON ASSEMBLY FOR AN ARTICLE OF FOOTWEAR

(75) Inventor: Bradley S. Long, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 904 days.

(21) Appl. No.: 13/021,102

(22) Filed: Feb. 4, 2011

(65) Prior Publication Data

US 2012/0198727 A1 Aug. 9, 2012

(51) Int. Cl.

| | |
|---|---|
| ***A43C 1/00*** | (2006.01) |
| ***A43B 23/02*** | (2006.01) |
| ***A43C 11/16*** | (2006.01) |
| ***A43C 5/00*** | (2006.01) |

(52) U.S. Cl.

CPC ..... *A43C 11/16* (2013.01); *A43B 23/0265* (2013.01); *A43C 1/00* (2013.01); *A43C 5/00* (2013.01); *A43B 23/0235* (2013.01)

USPC ..... 36/50.1; 36/45; 36/57

(58) Field of Classification Search

CPC ..... A43C 1/00; A43C 1/04

USPC ..... 36/50.1, 45, 57

See application file for complete search history.

(56) References Cited

U.S. PATENT DOCUMENTS

| | | | | |
|---|---|---|---|---|
| 975,820 | A * | 11/1910 | Azzara | 36/89 |
| 4,592,154 | A | 6/1986 | Oatman | |
| 5,271,130 | A * | 12/1993 | Batra | 24/714.6 |
| 5,291,671 | A | 3/1994 | Caberlotto et al. | |
| 5,371,957 | A | 12/1994 | Gaudio | |
| 6,029,376 | A | 2/2000 | Cass | |
| 6,032,387 | A | 3/2000 | Johnson | |
| 6,427,361 | B1 | 8/2002 | Chou | |
| 6,701,644 | B2 * | 3/2004 | Oorei et al. | 36/129 |
| 7,200,957 | B2 | 4/2007 | Hubbard et al. | |
| 7,293,371 | B2 | 11/2007 | Aveni | |
| 7,574,818 | B2 | 8/2009 | Meschter | |
| 7,631,440 | B2 | 12/2009 | Keen et al. | |
| 8,631,589 | B2 * | 1/2014 | Dojan | 36/45 |
| 2004/0181972 | A1 * | 9/2004 | Csorba | 36/50.1 |
| 2006/0000116 | A1 | 1/2006 | Brewer | |

(Continued)

FOREIGN PATENT DOCUMENTS

| | | | |
|---|---|---|---|
| CN | 101077234 | 11/2007 | |
| CN | 101583294 | 11/2009 | |
| DE | 10228143 A1 * | 11/2003 | A43B 5/00 |

OTHER PUBLICATIONS

International Preliminary Report on Patentability (including Written Opinion of the ISA) mailed Aug. 15, 2013 in International Application No. PCT/US2012/023600.

(Continued)

*Primary Examiner* — Ted Kavanaugh

(74) *Attorney, Agent, or Firm* — Plumsea Law Group, LLC

(57) ABSTRACT

A tendon assembly for an article of footwear is disclosed. The tendon assembly includes a tendon positioned between a base layer and a cover layer in a non-bonded manner such that the tendon may move freely within the layers. The tendon assembly may be rigidly secured to a shoe upper. One end of the tendon may be rigidly secured at or near the sole of the footwear. A second portion of the tendon may be integrated with a fastening system of the footwear such that the tendon may pull the footwear upper snugly against a wearer's foot to provide added support.

20 Claims, 19 Drawing Sheets

(56) References Cited

U.S. PATENT DOCUMENTS

| | | | | |
|---|---|---|---|---|
| 2006/0185194 | A1 | 8/2006 | Hubbard et al. | |
| 2007/0271822 | A1* | 11/2007 | Meschter | 36/45 |
| 2008/0086911 | A1 | 4/2008 | Labbe | |
| 2008/0110048 | A1 | 5/2008 | Dua et al. | |
| 2009/0199435 | A1 | 8/2009 | Robinson, Jr. et al. | |
| 2010/0037483 | A1* | 2/2010 | Meschter et al. | 36/47 |
| 2010/0154256 | A1* | 6/2010 | Dua | 36/25 R |
| 2013/0019500 | A1* | 1/2013 | Greene | 36/50.1 |

OTHER PUBLICATIONS

International Search Report and Written Opinion mailed Jun. 5, 2012 in International Application No. PCT/US2012/023600.

Chinese Office Action dated Jun. 27, 2014 in Chinese Patent Application 201280007122.2.

Chinese Search Report dated Jun. 19, 2014 in Chinese Patent Application 201280007122.2.

* cited by examiner

TENDON ASSEMBLY FOR AN ARTICLE OF FOOTWEAR

BACKGROUND

The present invention relates generally to a tendon assembly for an article of footwear.

Most articles of footwear comprise both an upper piece and a sole. The upper is generally designed to enclose a wearer's foot, and in some circumstances to provide support for the foot during motion. The sole is generally designed to provide traction, protection, and also to support the foot. Traditionally, articles of footwear that provide added support to a wearer's foot have included either a stiff upper, such as a leather upper, or an upper made from another heavy and non-breathable material.

SUMMARY

In one aspect, an article of footwear includes an upper, where the upper is connected to a fastening region. The upper includes an opening, and at least a portion of the opening is adjustable by a fastening system. The article of footwear also include a sole attached to the upper and a tendon assembly secured to the upper between the sole and the fastening region. The tendon assembly includes a base layer, a top layer connected to the base layer, and a tendon positioned between the base layer and the top layer. The tendon moves freely between the base layer and the top layer and the tendon is configured to move with the fastening system.

In another aspect, a tendon assembly is provided for placement on an article of footwear. The tendon assembly includes a base layer, an upper layer that attaches to the base layer. The base layer and the upper layer together define a space that runs the length of the tendon assembly. The tendon assembly further includes a tendon positioned in the space. The tendon is configured to move freely within the space, and the tendon may be integrated with a fastening system on the article of footwear.

In another aspect, an article of footwear an upper, where the upper includes a fastening region with a fastening system. A sole is attached to the upper, and a tendon assembly is further attached to the upper, running from an area proximate the sole to an area proximate the fastening region. The tendon assembly comprises a base layer, a top layer attached to the base layer, and a tendon positioned between the base layer and the top layer such that the tendon moves freely between the base layer and the top layer, and the tendon further extends into the fastening region.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles described herein. Moreover, in the figures, like reference numerals designate corresponding parts throughout the different views.

DETAILED DESCRIPTION

Figure 1:
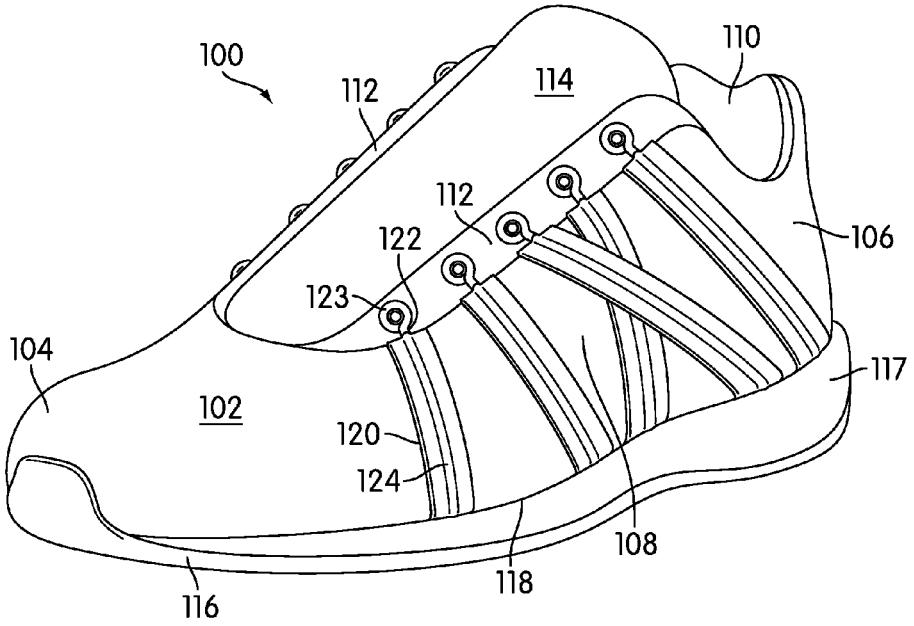
FIG. 1 is a side perspective view of an embodiment of an article of footwear incorporating tendons.
Figure 2:
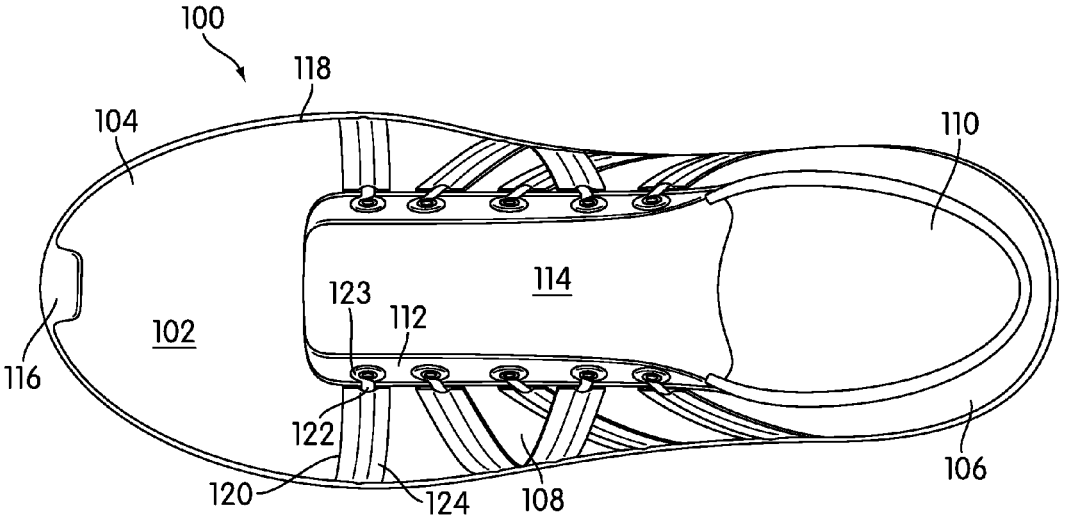
FIG. 2 is a top view of an embodiment of an article of footwear incorporating tendons.

FIG. 1 depicts a side perspective view of an embodiment of an article of footwear 100, also referred to as simply article 100, incorporating tendons in accordance with an embodiment described herein. FIG. 2 depicts a top view of the same article 100. Article 100 could take the form of any kind of footwear including, but not limited to: hiking boots, soccer shoes, football shoes, sneakers, rugby shoes, basketball shoes, baseball shoes as well as other kinds of shoes. Articles of footwear associated with the present embodiments may also take the form of any non-athletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

Article 100 may be adapted for use in an athletic-related activity, though is not meant to be restricted to use in athletic- or sports-related activities. For example, some of the provisions incorporated in article 100 that are useful in athletic- or sports-related activities may be equally applicable in a variety of contexts or non-sports-related activities. These provisions include features such as a lightweight upper and overall structure combined with increased support to the foot. These and other features of certain embodiments of article 100 are discussed in more detail below.

As seen in FIGS. 1-2, article 100 includes upper 102 (note that reference numbers carry over for like parts throughout the detailed description and the figures). Upper 102 further includes an opening 110 at the heel/ankle end 106 for inserting a wearer's foot into article 100, and a fastening region 112. Opening 110 may be limited to the heel/ankle area 106 of article 100 or may extend along the top of upper 102 into, and include, fastening region 112. Thus, in one embodiment upper 102 may be integrated with fastening region 112, and in another embodiment fastening region 112 may be separately affixed to upper 102. Fastening region 112 may be situated along the midstep region 108 of upper 102 as shown in FIGS. 1-2, or may be situated at other parts of article 100, as would be apparent to those of skill in the art.

Fastening region 112 may include a fastening system for tightening article 100 around a wearer's foot, as discussed in more detail below. Examples of different fastening systems that could be used with fastening region 112 include, but are not limited to: lacing systems, strap systems as well as any other kinds of systems. Thus, fastening region 112 may be configured in a variety of ways to accommodate different types of fastening systems.

Upper 102 may further include a separate provision, such as tongue 114, which may be attached to upper 102 under fastening region 112. In some cases, tongue 114 may be rigidly attached only at the toe end 104 of upper 102. In other cases, tongue 114 may be additionally rigidly attached along a portion of the fastening region 112. In still other cases, tongue 114 may be attached at the toe end 104 and along the entirety of fastening region 112. Depending on how tongue 114 is attached to upper 102, opening 110 may be of varying sizes when tongue 114 is lifted up from fastening region 112. In addition, tongue 114 may be configured as a portion of upper 102.

In some embodiments, upper 102 may be made of a lightweight and breathable material, such as a woven nylon, polyester, or other woven fiber. Upper 102 may also be made of a water durable material such as neoprene or other similar material. Those skilled in the art will readily appreciate the array of materials that may be used for upper 102 and, as such, will recognize that the previously listed materials are for exemplary purposes only.

Article 100 may further include a sole 116, including midsole 117 which may be attached to upper 102 along lasting margin 118. Those of skill in the art will recognize that there may be additional layer(s) between upper 102 and sole 116, such as an additional midsole or other padding layer. Skilled artisans will also recognize that article 100 may not include midsole 117 and yet still include certain provisions described herein. Moreover, in some cases, sole 116 could include an outsole that is disposed on a lower side of midsole 117.

Sole 116, midsole 117 and upper 102 may be attached by any means known in the art such as by stitching, cement or by use of another adhesive material. Midsole 117 may be constructed from a molded, padded material, as known in the art. Sole 116 may also be constructed from a molded padded material, or other durable material known in the art. In some embodiments, sole 116 may further include provisions on the bottom for traction, such as a non-skid or non-slip surface, cleats, or other similar features. In some cases, these provisions could be associated with an outsole of sole 116.

According to an embodiment described herein, article 100 may also include provisions for added support and stability on upper 102, such as one or more tendon assemblies 120. For simplicity, only one of multiple tendon assemblies 120 shown in FIGS. 1-2 have been labeled. According to aspects described herein, a tendon 122 may be provided between a base layer 302 (refer to FIGS. 3-4) and a separate top/cover layer 124 to form tendon strand assembly 120. As discussed in more detail below, tendon 122 may form a loop 123 and protrude slightly from tendon assembly 120 at the top of the assembly in fastening region 112. Thus, tendon 122 may be integrated with a fastening system to provide added support to upper 102, as described in more detail below.

Figure 3:
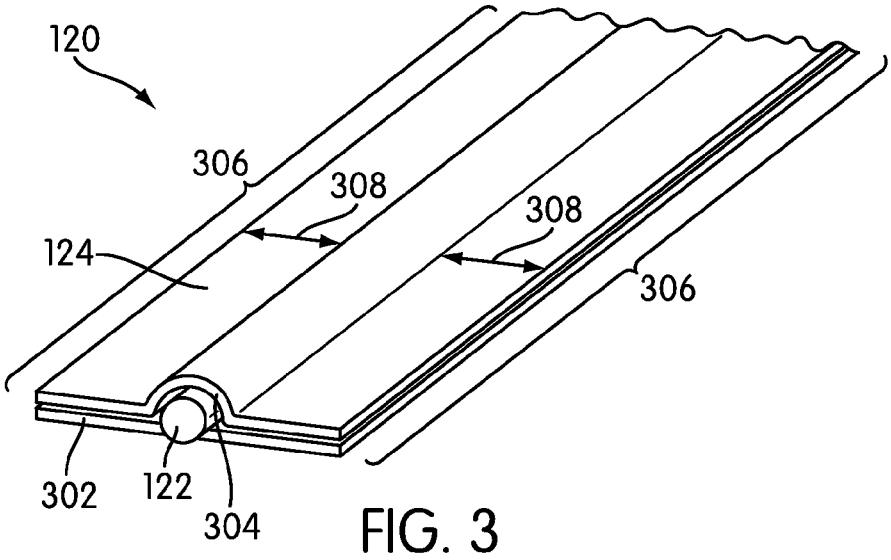
FIG. 3 is a perspective view of an embodiment of a tendon assembly.
Figure 4:
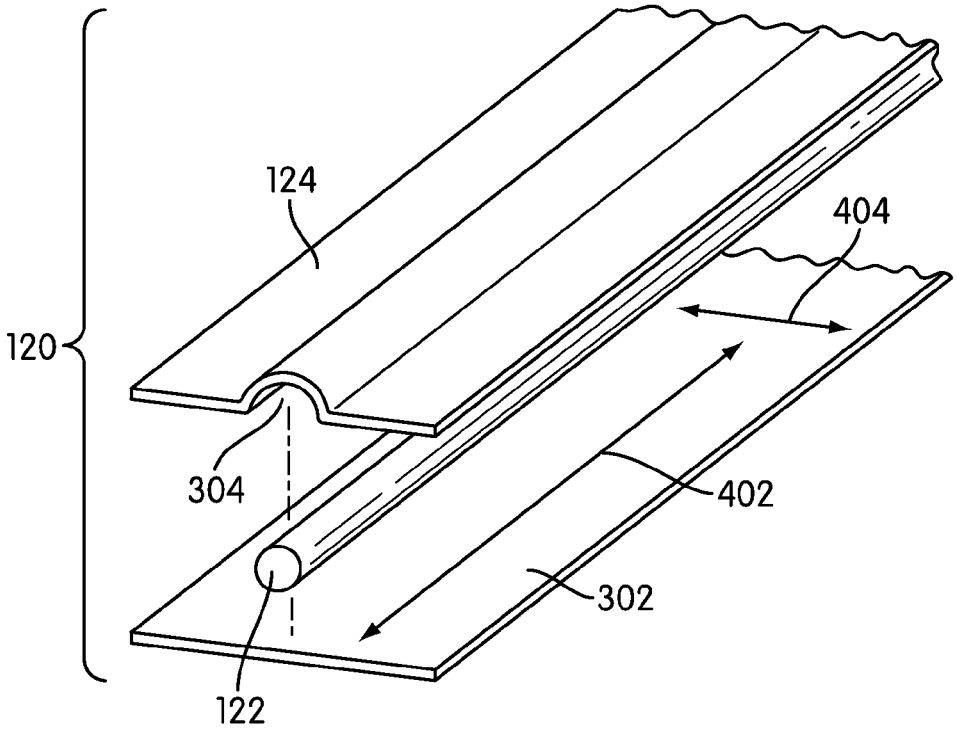
FIG. 4 is an exploded perspective view of an embodiment of a tendon assembly.

FIG. 3 depicts a perspective view of tendon assembly 120 and FIG. 4 depicts an exploded perspective view of tendon assembly 120, both according to an embodiment described herein. Referring to FIGS. 3-4, tendon assembly 120 may comprise a freely movable tendon 122 that is positioned in a space between a base layer 302 and a top/cover layer 124 in a non-bonded manner such that tendon 122 may move freely between the base layer 302 and the top/cover layer 124. Cover layer 124 may further include a channel 304 for insertion and/or positioning of the tendon 122 within assembly 120. Base layer 302 and top/cover layer 124 may be configured as a sheath around tendon 122 and may serve to protect and prevent abrasion to tendon 122.

According to aspects described herein, the entire tendon assembly 120, i.e. the tendon 122, the base layer 302 and the top/cover layer 124, together, may be secured and positioned on shoe upper 102, running from lasting margin 118 to the fastening region 112 on either the lateral or medial side of upper 102, or at any other appropriate position on the shoe upper as would be understood by those skilled in the art. According to at least one embodiment, base layer 302 may be attached to upper 102 by adhesive. In other embodiments, base layer 302 may be attached to upper 102 by stitching or by any other method providing rigid attachment as known to those skilled in the art. Top/cover layer 124 may be similarly rigidly attached and secured to base layer 302 along edges 306, such that tendon 122 has movement within tendon assembly 120 in a space defined between top/cover layer 124 and base layer 302. According to an alternative embodiment, cover layer 124 may also be secured between edges 306 and channel 304 (area marked by arrows 308) such that tendon 122 may only move freely within channel 304.

In some embodiments, tendon 122 may move in a longitudinal direction 402 within tendon assembly 120, which is a direction directed approximately along the length of tendon assembly 120. As tendon 122 moves in the longitudinal direction 402, portions of tendon 122 may move towards or away from fastening region 112. In other embodiments, tendon 122 may move in a lateral direction 404 within tendon assembly 120, which is a direction approximately along the width of tendon assembly 120, and approximately perpendicular to longitudinal direction 402.

Tendon 122, base layer 302 and cover layer 124 may be constructed of any suitable material known to those skilled in the art. It is contemplated that tendon 122 may comprise a woven cord made from nylon, polyester, rayon, or other suitable fiber known to the skilled artisan. Outer layer 124 and base layer 302 of tendon assembly 120 may comprise any material that allows tendon 122 to slip easily within assembly 120. Such materials may include, but are not limited to, a woven fabric such as nylon, polyester, rayon, neoprene or other suitable fiber known to the skilled artisan. Those skilled in the art will recognize the breadth of materials suitable for constructing tendon 122, layer 302 and layer 124 and will recognize that the above-listed materials serve only as examples among many suitable materials.

Figure 5:
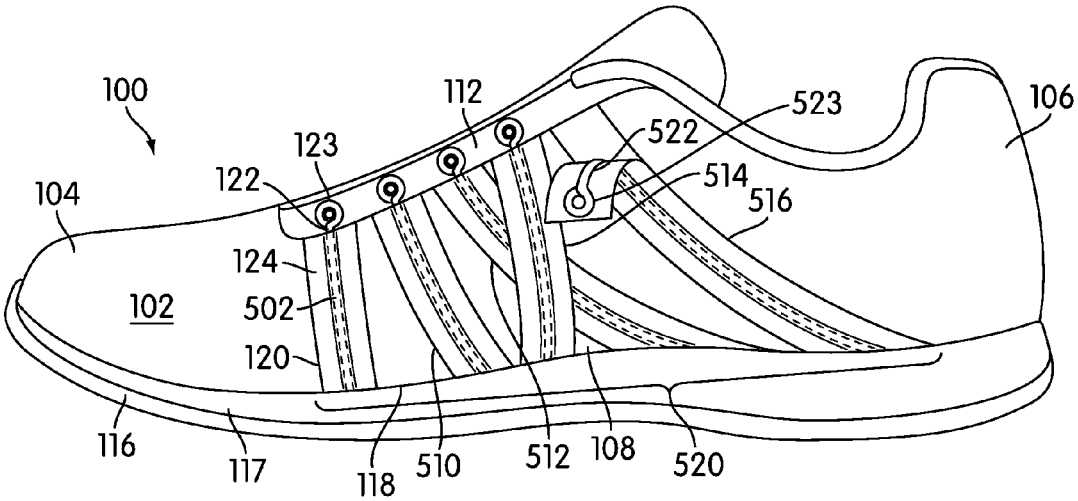
FIG. 5 is a side view of an embodiment of an article of footwear incorporating tendons, wherein the placement of the tendons within their respective assemblies is shown.
Figure 6:
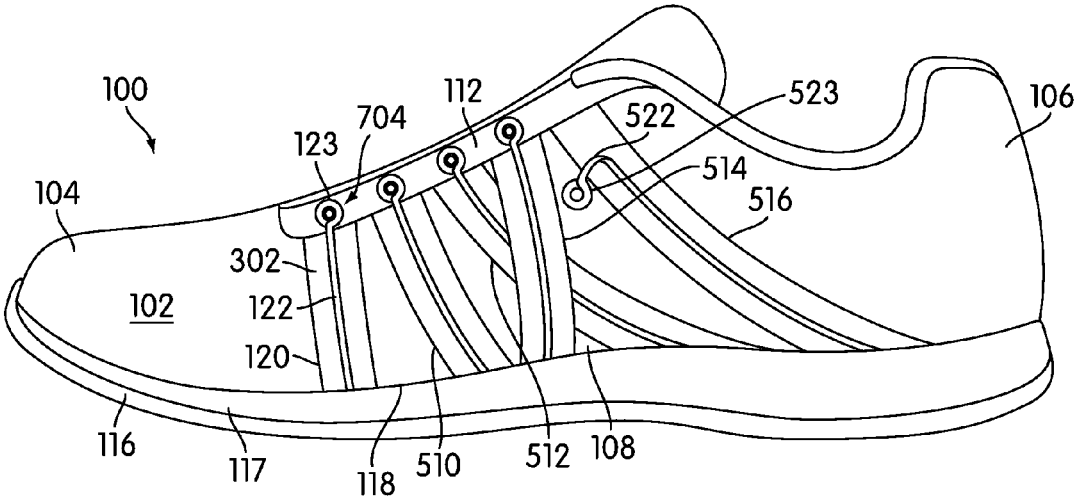
FIG. 6 is a side view of an embodiment of an article of footwear incorporating tendons, wherein the cover layer of the tendon assemblies has been removed.

FIGS. 5 and 6 depict side views of article 100 according to an embodiment described herein, wherein the placement of tendons 122 are shown within their respective assemblies 120. As can be seen in FIG. 5, tendons 122 (shown the length of tendon assembly 120 with phantom lines 502) may be positioned under cover layer 124 and run from lasting margin 118 to fastening region 112. In FIG. 6, cover layer 124 has been removed to reveal tendon assemblies 120.

As previously noted, a tendon assembly 120 may be secured and positioned on shoe upper 102, running from lasting margin 118 to the fastening region 112 on either the lateral or medial side of upper 102, or at any other appropriate position on the shoe upper. As would be understood by those skilled in the art, an article of footwear may have any number of tendon assemblies positioned in any location on the shoe upper. For example, a tendon assembly could be positioned to come straight down from the fastening region, to come down at an angle from the fastening region, i.e. to be angled from a heel end of the upper to the toe end of the upper (or vice versa), or could be positioned to overlap with another tendon assembly. In addition, tendon assemblies may be positioned on the medial or lateral side of the upper, in the midstep region of the upper, towards the toe end of the upper, and/or towards the heel end of the upper.

According to at least one embodiment, tendon assemblies may be positioned to provide support in the midstep region of a shoe upper. To illustrate one embodiment of how tendon assemblies may be arranged on an upper, the remaining tendon assemblies are illustrated in FIGS. 5 and 6 and include tendon assembly 510, tendon assembly 512, tendon assembly 514 and tendon assembly 516, which may be referred to collectively as tendon assemblies 520. As shown in the embodiment of FIGS. 5 and 6, tendon assembly 120 is positioned closest to the toe end 104 of upper 102 and is angled mostly straight down from fastening region 112. Tendon assembly 510, tendon assembly 512 and tendon assembly 516 are angled from fastening region 112 towards the heel end 106 of upper 102. Tendon assembly 514 is also angled mostly straight down from fastening region 112, but crosses over tendon assembly 512.

Referring to FIGS. 5 and 6, tendon assembly 516 and tendon 522 with loop 523 are shown peeled back to illustrate how tendon 522 is separate from fastening region 112. In the embodiment shown in FIGS. 5 and 6, loop 523 of tendon 522 may comprise the eyelet for lacing the shoelace. According to other embodiments (not shown), loop 523 may be aligned with an eyelet situated on fastening region 112, and in such embodiments, may be integrated with a separate fastening system on upper 102.

Figure 7:
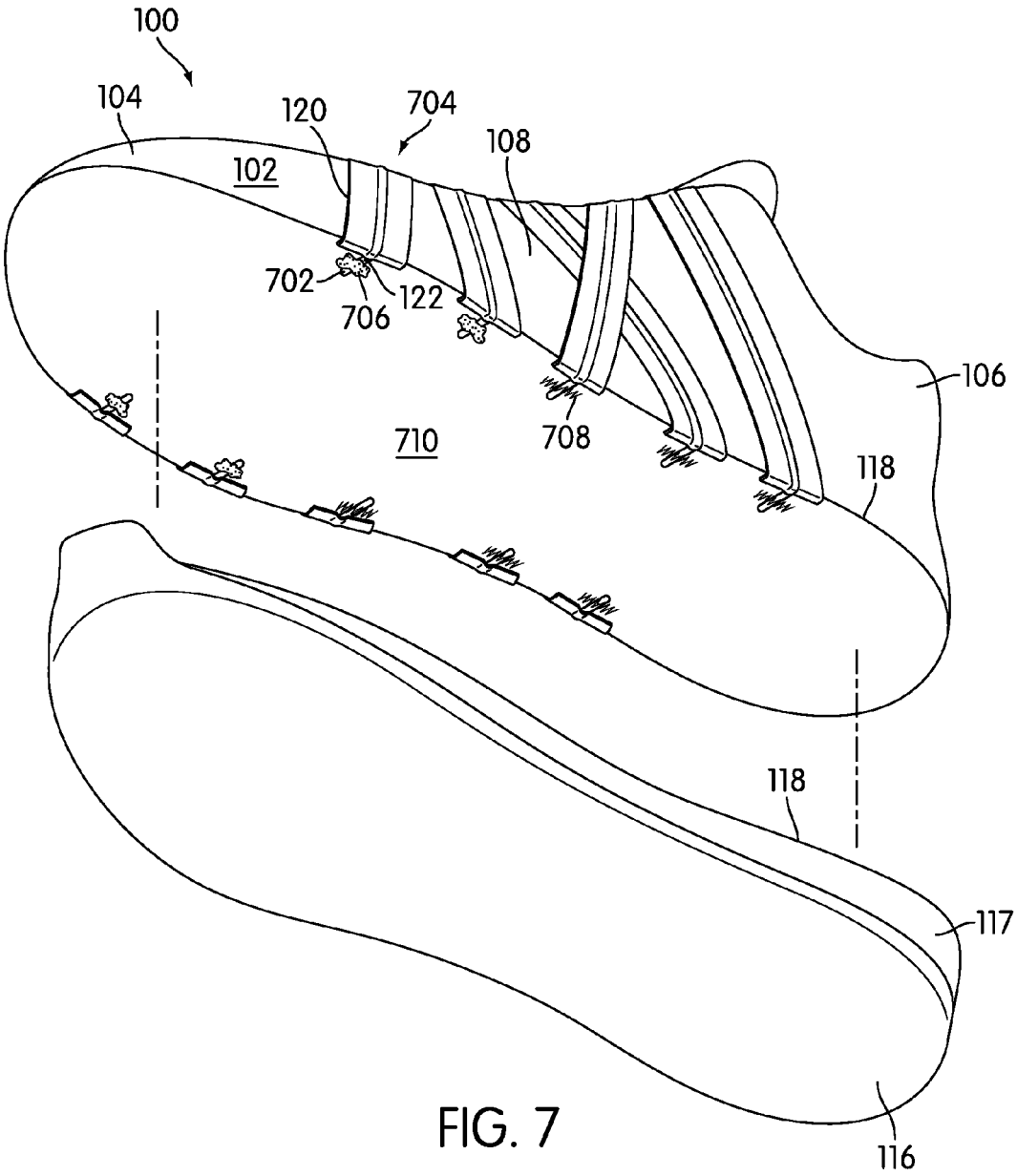
FIG. 7 is an exploded bottom perspective view of an embodiment of an article of footwear incorporating tendons.

FIG. 7 depicts an exploded bottom perspective view of article 100 according to an embodiment described herein. As seen in FIG. 7, sole 116 and midsole 117 are removed from upper 102, exposing attachment points for tendons 122. Again, for simplicity, only one of multiple tendon assemblies 120 shown in FIG. 7 has been labeled. According to the embodiment depicted in FIG. 7, tendons 122 may have a first end 702 proximate the lasting margin 118 of article 100 and a second end 704 proximate a fastening region, such as fastening region 112 of FIG. 1 (see FIG. 6).

As depicted in FIG. 7, first end 702 of tendons 122 may be rigidly secured at or near lasting margin 118. In the embodiment of FIG. 7, first end 702 of tendons 122 are secured underneath upper 102 proximate the lasting margin 118. Tendon assemblies 120 may also be secured at any position on the bottom 710 of upper 102, or even further up on the side of upper 102 (e.g., in the mid-step region 108 of upper). Tendons 122 may be secured by an adhesive 706, such as glue or cement, by stitching 708, or by any means known to those skilled in the art. For purposes of illustration, multiple methods of securing tendon assemblies 120 to upper 102 are shown in FIG. 7, however in some embodiments each tendon assembly may be secured using the same method.

Figure 8:
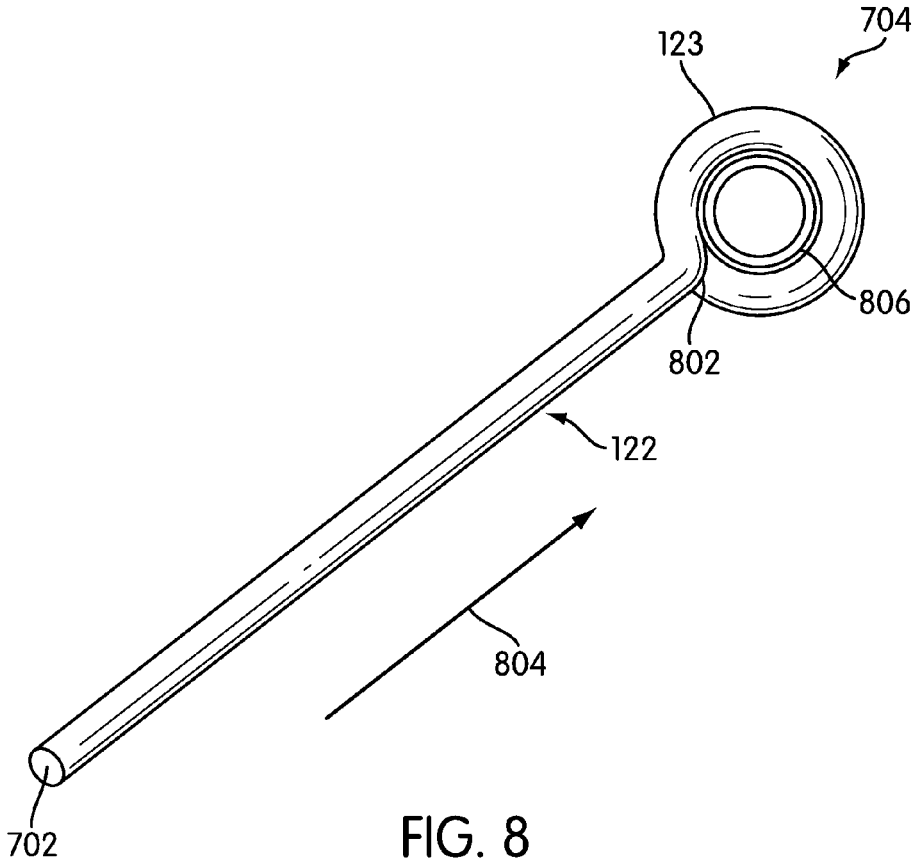
FIG. 8 is an embodiment of a tendon.

FIG. 8 depicts a tendon 122 according to an embodiment described herein. As previously described, tendon 122 may have a first end 702 and second end 704. First end 702 may be rigidly secured or attached at or near the lasting margin of an article of footwear. Second end 704 may be configured to engage with a fastening system. In the embodiment depicted in FIG. 8, second end 704 may be secured in a loop 123 to engage with a means for fastening an article of footwear such as a shoelace, or any other means contemplated by a skilled artisan. Loop 123 may be secured at attachment point 802 by any method known in the art, such as by stitching or an adhesive. A shoelace (not shown in FIG. 8) may be threaded through loop 123 to pull tendon 122 in direction 804, as described in more detail below. Loop 123 of tendon 122 may be reinforced with element 806 to prevent abrasion to tendon 122 by a fastening system. Thus, according to aspects described herein, tendons 122 may be freely movable within tendon assembly 120, as discussed above, such that engagement by a fastening system at loop 123 would allow a tendon 122 to pull against the rigid attachment of tendon 122 at first end 702 and to tighten, pulling upper 102 closer and more snugly to a wearer's foot.

Figure 9:
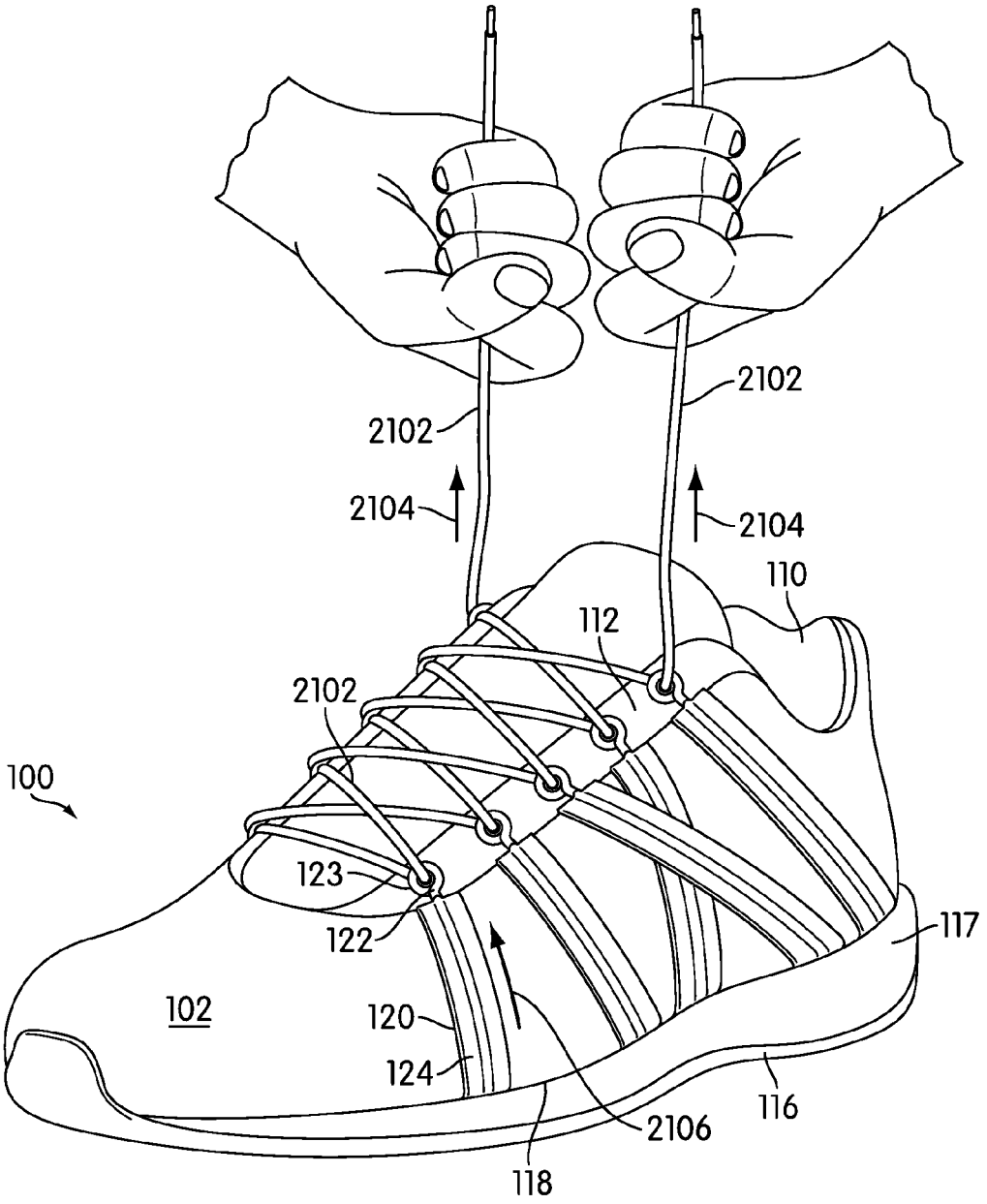
FIG. 9 is a side perspective view of an embodiment of an article of footwear with fastening system incorporating tendons.

According to an embodiment described herein, article of footwear, e.g. article 100, may also include provisions for added support and stability on upper 102, such as tendon assemblies 120, as described above. FIG. 9 depicts a perspective view of article 100 with fastening system 2102 engaging tendons 122 at loop 123 for added support and stability. Fastening system 2102 may include shoe laces or any other type of cord or other fastening system, as known in the art. As depicted in FIG. 9, a wearer may insert a foot in opening 110 of article 100 and pull on laces 2102 in direction 2104 to tighten article 100 around the foot. Laces 2102 may be engaged with tendons 122 at loops 123 such that as the wearer pulls in direction 2104, tendons 122 may be pulled in a direction towards the wearer's foot, e.g. direction 2106, effectively pulling upper 102 more snugly against the wearer's foot.

Figure 10:
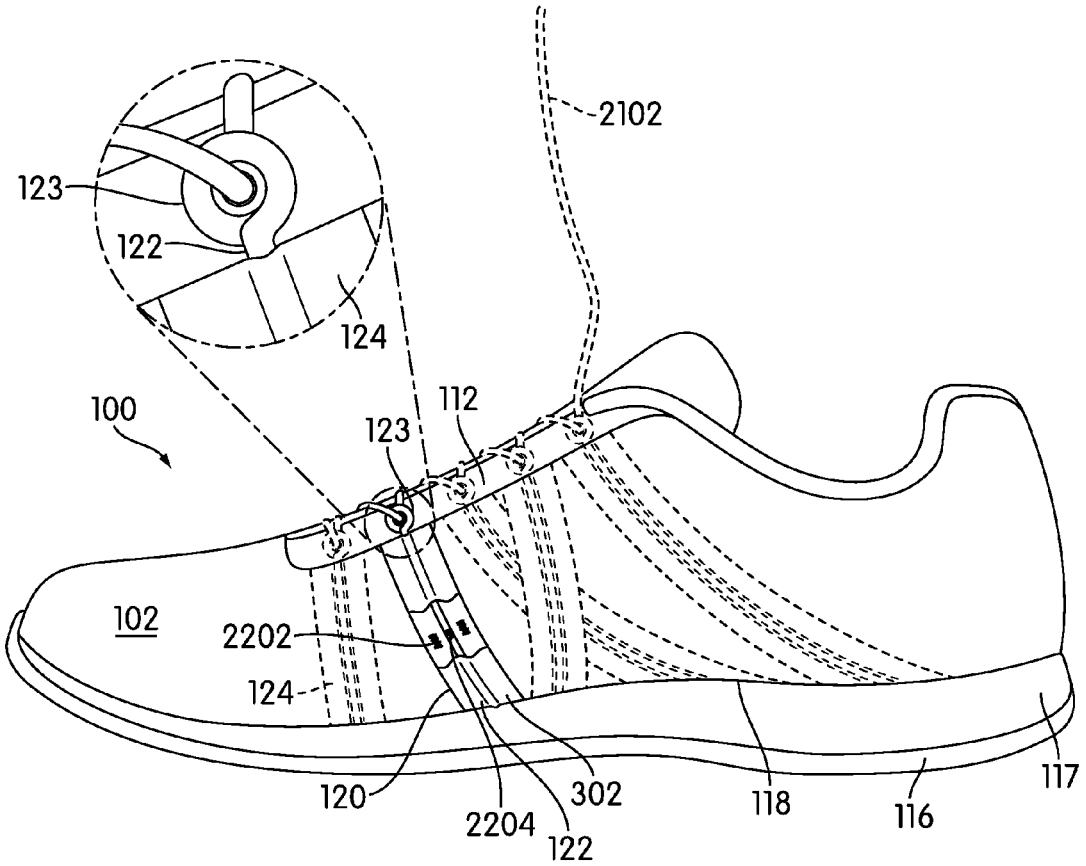
FIG. 10 is a side view of an embodiment of an article of footwear incorporating tendons, wherein the cover layer of the tendon assemblies has been partially removed to show placement of the tendons before a fastening system is tightened.
Figure 11:
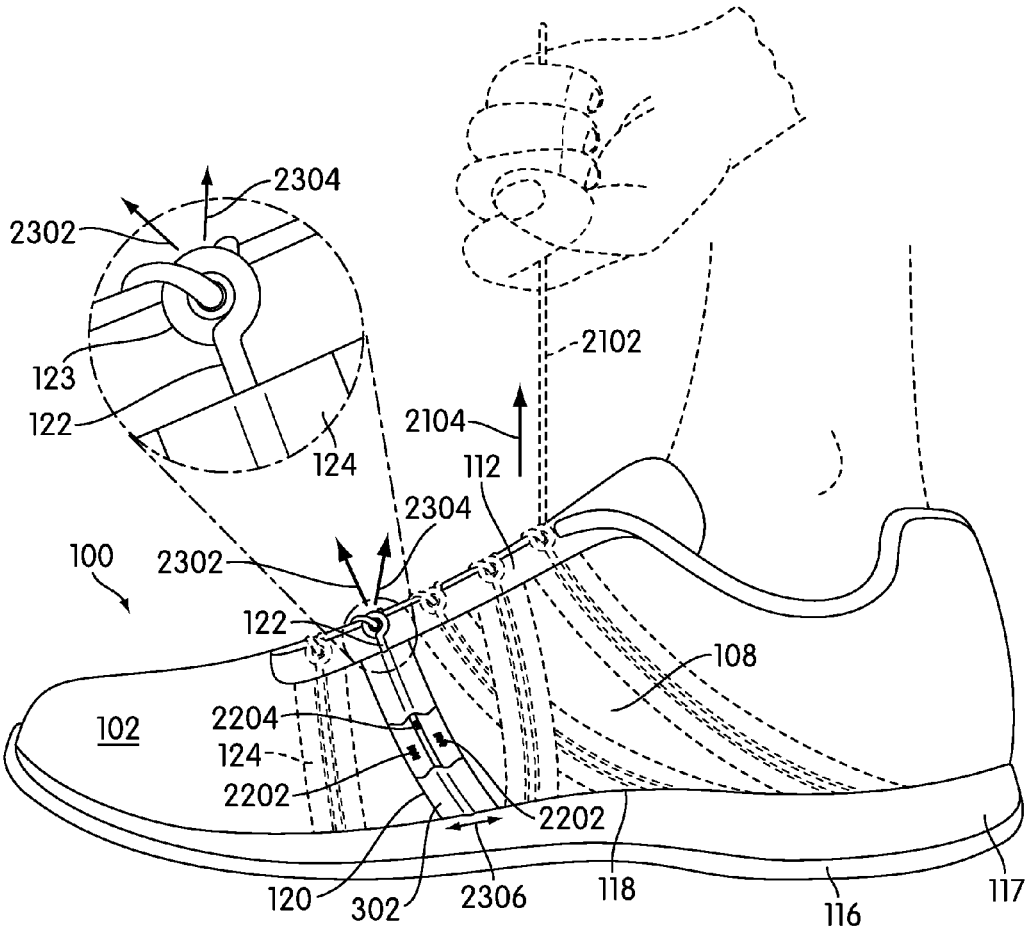
FIG. 11 is a side view of an embodiment of an article of footwear incorporating tendons, wherein the cover layer of the tendon assemblies has been partially removed to show movement of the tendons after a fastening system is tightened.

FIGS. 10 and 11 depict a side view of article 100, wherein a portion of cover 124 of one tendon assembly 120 has been removed to show how tendon 122 may freely move between top/cover layer 124 and base layer 302. For simplicity, the remaining tendon assemblies 120 on article 100 in FIGS. 10 and 11 are shown in phantom and not labeled.

As has been previously described, tendon 122 may be configured to freely move within tendon assembly 120. Marks 2202 and mark 2204, shown in FIGS. 10 and 11, depict the movement of tendon 122 according to an embodiment set forth herein. Marks 2202 are applied to base layer 302 and mark 2204 is applied to tendon 122. It will be understood that marks 2202 and mark 2204 are only shown for purposes of illustrating the movement of tendon 122 within tendon assembly 120. In a normal position (i.e. no tension being applied to laces 2102), tendon 122 may rest at the position shown in FIG. 10, wherein marks 2202 and mark 2204 line up across tendon assembly 120. As tension is applied to laces 2102 in direction 2104, tendon 122 may be pulled at loop 123, against an attachment point at lasting margin 118, to hug the wearer's foot and pull upper 102 against the wearer's foot. As can be seen in FIG. 11, the tightening of a fastening system may cause tendon 122 to move within tendon assembly 120, between base layer 302 and cover 124. As tendon 122 is pulled, tendon 122 may move up in direction 2302, as well as in direction 2304 towards the arch of wearer's foot, to tighten upper 102 around the wearer's foot, providing additional support to wearer's foot. The movement of tendon 122 is shown by the shifted position of mark 2204 with respect to marks 2202, which remain stable on upper 102. Those of skill in the art will recognize that the movement of tendon 122 depicted in FIGS. 10 and 11 is for exemplary purposes only, and that tendon 122 may move more or less than depicted, and may also move slightly in a lateral direction 2306 within tendon assembly 120 when tension is applied.

Thus, as can be understood from the embodiment shown in FIG. 11, tendon assemblies 520 may provide additional support along upper 102, and specifically, in mid-step region 108 of upper 102 as laces 2102 are tightened. Additional support may be beneficial in a variety of athletic and non-athletic contexts as described above, and may be particularly beneficial when upper 102 is constructed from a lightweight material with no intrinsic structure or support.

Figure 12:
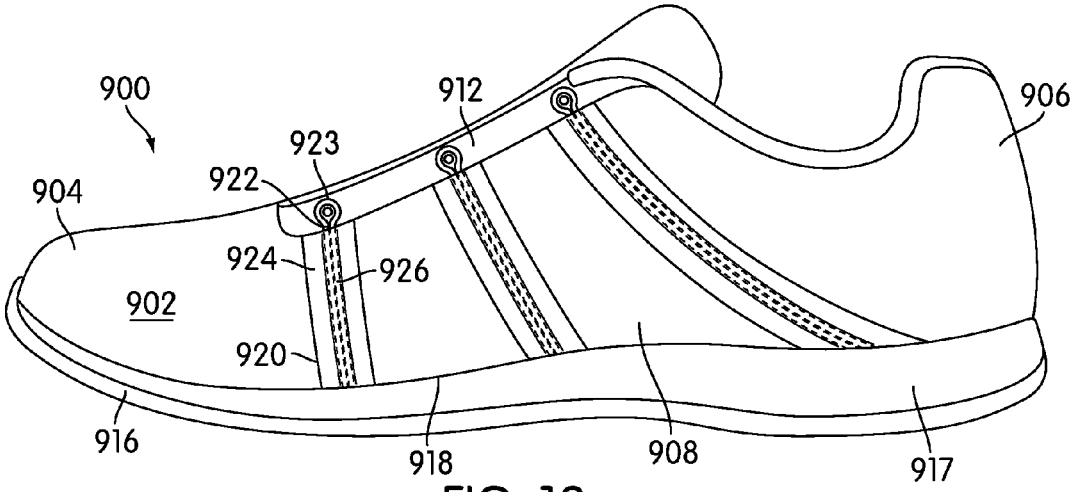
FIG. 12 is a side view of an embodiment of an article of footwear incorporating tendons, wherein the placement of the tendons within their respective assemblies is shown.
Figure 13:
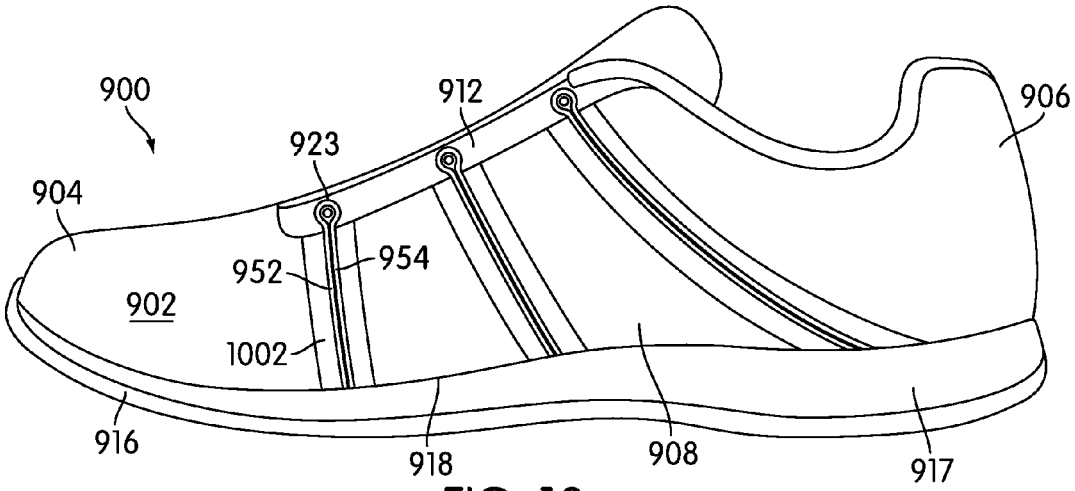
FIG. 13 is a side view of an embodiment of an article of footwear incorporating tendons, wherein the cover layer of the tendon assemblies has been removed.

It will be understood that tendons may be arranged in a variety of ways and still fall within the spirit and scope of the present disclosure. For example, in one embodiment, both the first and second end of a tendon may be positioned at the lasting margin, with the midpoint of the tendon forming a loop in the fastening region for engaging a fastening system. FIGS. 12 and 13 depict side views of an article of footwear 900 according to another embodiment described herein, wherein the placement of tendons 922 are shown within their respective tendon assemblies 920. Again, for simplicity, only one of multiple tendon assemblies 920 shown in both FIGS. 12 and 13 have been labeled.

The embodiment of article 900 is similar to the embodiment depicted and discussed in the foregoing FIGS. 1-2 and 5-7 in that article 900 includes an upper 902 attached to a sole 916. As depicted in FIG. 12, article 900 may also include a midsole 917. Midsole 917 may be attached to upper 902 at lasting margin 918, but those skilled in the art will recognize that article 900 may be constructed without a midsole 917 or may be constructed with additional layers between upper 902 and sole 916. Upper 902 may further be referred to as having a toe end 904, an ankle/heel end 906 and a midstep region 908. Upper 902 may also include fastening region 912, which may be a separate piece attached by known means to upper 902 or may be constructed from upper 902.

According to the embodiment depicted in FIG. 12, tendons 922 (shown the length of tendon assembly 920 with phantom lines 926) may be positioned under cover layer 924 and run from lasting margin 918 to fastening region 912 and back to lasting margin 918 to form loop 923 in fastening region 912. Loop 923 may be configured to engage a fastening system such as a shoe lace, as discussed previously. The ends of tendons 922 may be rigidly attached under upper 902 as discussed in relation to FIG. 7, above. Furthermore, according to aspects described herein, tendons 922 may be freely movable within tendon assembly 920, as discussed above, such that engagement by a fastening system at loop 923 could allow a tendon 922 to pull against the rigid attachment of tendon 922 at lasting margin 918 and to tighten, pulling upper 902 closer and more snugly to a wearer's foot and providing support to a wearer's foot.

FIG. 13 depicts a side view of article 900, wherein cover layers 924 of tendon assemblies 920 have been removed, revealing tendons 922. As can be seen in the embodiment of FIG. 13, each tendon 922 may be looped (loop 923) at fastening region 912 such that within tendon assembly 920, tendon 922 forms two strands. In particular, tendon 922 includes first strand 952 and second strand 954.

Figure 14:
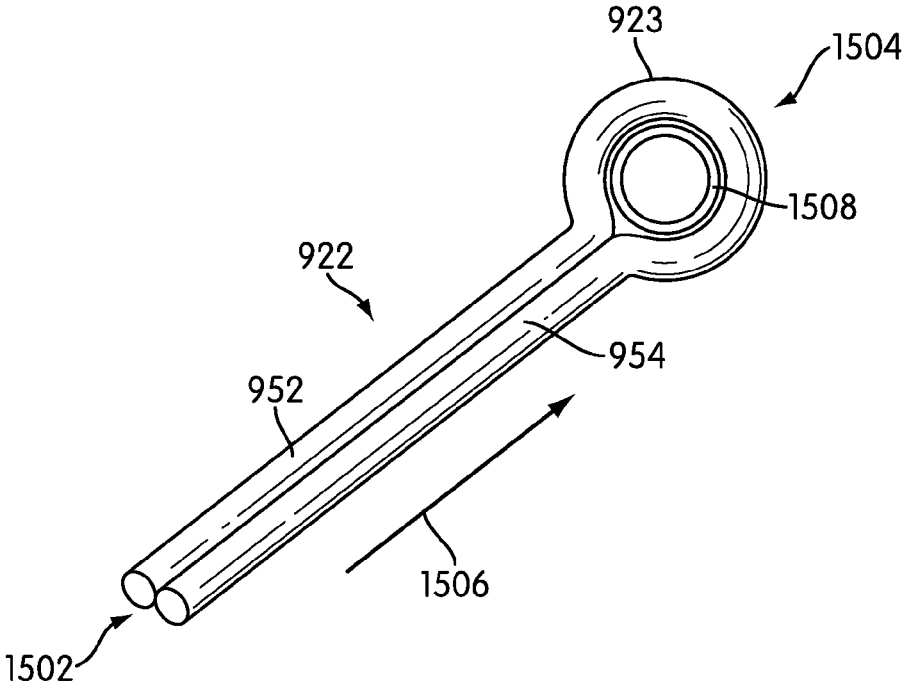
FIG. 14 is an embodiment of a tendon.

FIG. 14 depicts an exemplary tendon 922 according to the embodiment depicted in FIGS. 12-13. As previously described, tendon 922 may be looped (at loop 923) to form two strands, strand 952 and strand 954. The ends of strand 952 and strand 954 may meet at a first end 1502. Additionally, strands 952 and strand 954 are joined as loop 923 at an opposite end 1504. The ends of strand 952 and strand 954 may be rigidly secured or attached at end 1502 at or near the lasting margin of an article of footwear. The opposite end 1504 may be configured to engage with a fastening system.

In the embodiment depicted in FIG. 14, second end 1504 may be secured in a loop 923 to engage with a means for fastening an article of footwear such as a shoelace, or any other means contemplated by a skilled artisan. A shoelace (not shown in FIG. 14) may be threaded through loop 923 (as previously described) to pull tendon 922 in direction 1506. In some embodiments, to prevent abrasion to tendon 922, loop 923 may be reinforced with element 1508, or by any other method readily known to a skilled artisan.

Thus, according to aspects described herein, tendons 922 may be freely movable within tendon assembly 920, as discussed in more detail below, such that engagement by a fastening system at loop 923 would allow tendon strands 952 and 954 to pull against their rigid attachment points at first end 1502 and to tighten, pulling upper 902 closer and more snugly to a wearer's foot and providing support to a wearer's foot.

Figure 15:
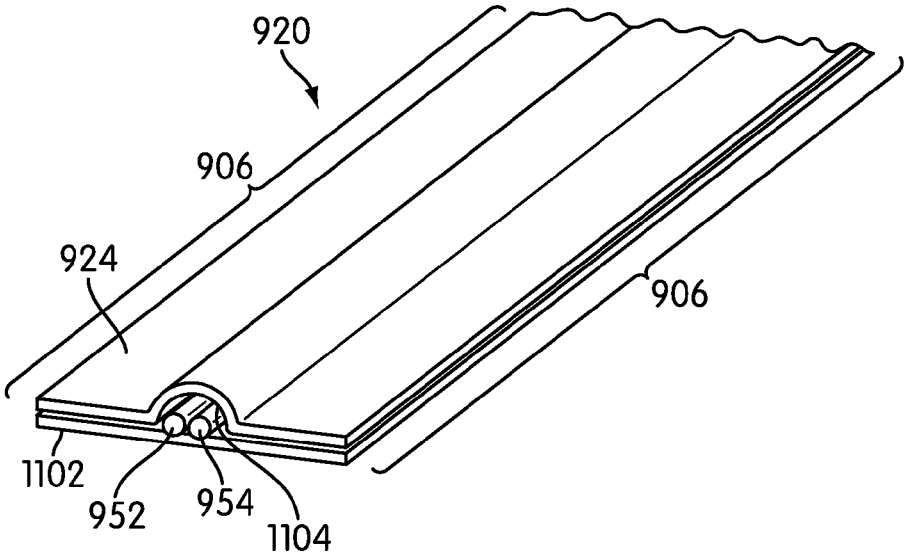
FIG. 15 is a perspective view of an embodiment of a tendon assembly.
Figure 16:
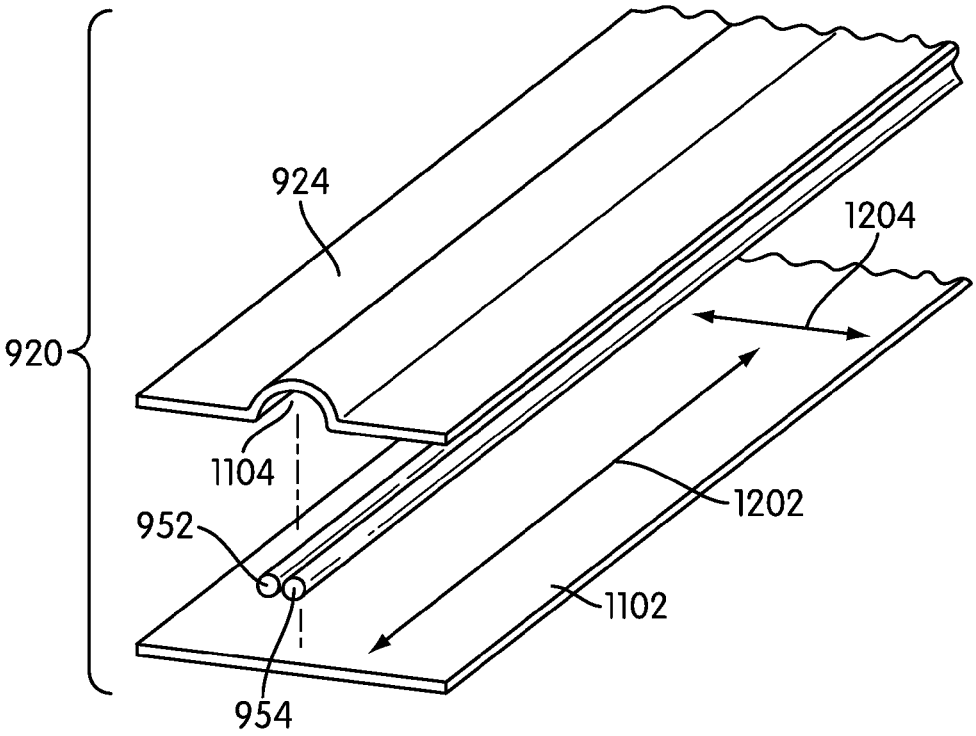
FIG. 16 is an exploded perspective view of an embodiment of a tendon assembly.

FIG. 15 depicts a perspective view of a tendon assembly 920 and FIG. 16 depicts an exploded perspective view of tendon assembly 920, both according to an embodiment described herein. Referring to FIGS. 15-16, tendon assembly 920 may comprise freely movable tendon 922 positioned between a base layer 1102 and a top/cover layer 924 in a non-bonded manner such that tendon 922 may move freely between the base layer 1102 and the top/cover layer 924. The ends of tendon strands 952 and 954 may be secured as discussed above in relation to the embodiment of FIG. 7. Cover layer 924 may further include a channel 1104 for insertion and/or positioning of tendon strands 952 and 954 within assembly 920. Base layer 1102 and top/cover layer 924 may be configured as a sheath around tendon strands 952 and 954 and may serve to protect and prevent abrasion to tendon 922.

According to aspects described herein, the entire tendon assembly 920, i.e. the tendon 922, the base layer 1102 and the top/cover layer 924 together, may be secured and positioned on shoe upper 902, running from lasting margin 918 to the fastening region 912 on either the lateral or medial side of upper 902, or at any other appropriate position on the shoe upper as would be understood by those skilled in the art. According to at least one embodiment, base layer 1102 may be attached to upper 902 by adhesive, by stitching or by any other method providing rigid attachment as known to those skilled in the art. Top/cover layer 924 may be similarly rigidly attached and secured to base layer along edges 906, such that tendon strand 952 and strand 954 have movement within tendon assembly 920. According to an alternative embodiment, cover layer 924 may also be secured between edges 906 and channel 904 (area marked by arrows 908) such that tendon strands 952 and 954 may only move freely within channel 904.

In some embodiments, tendon strands 952 and 954 may move in a longitudinal direction 1202 within tendon assembly 920, which is a direction directed approximately along the length of tendon assembly 920. As tendon 922 moves in the longitudinal direction, portions of tendon 922 may move in a lateral direction 1204 within tendon assembly 920, which is a direction approximately along the width of tendon assembly 920 and approximately perpendicular to longitudinal direction 1202.

Tendon 922, base layer 1102 and cover layer 924 may also be constructed pursuant to the methods and materials as set forth above in relation to previously discussed embodiments. However, those skilled in the art will recognize the breadth of materials suitable for constructing tendon 922 and layers 1102 and 924 and will recognize that the above-listed materials serve as only examples among many suitable materials.

As previously discussed, there are a variety of ways in which tendons and tendon assemblies may be configured, and still fall within the spirit and scope of the present disclosure. In another embodiment, for example, one tendon may be positioned in two separate tendon assemblies, and yet still provide added support and stability as described herein.

Figure 17:
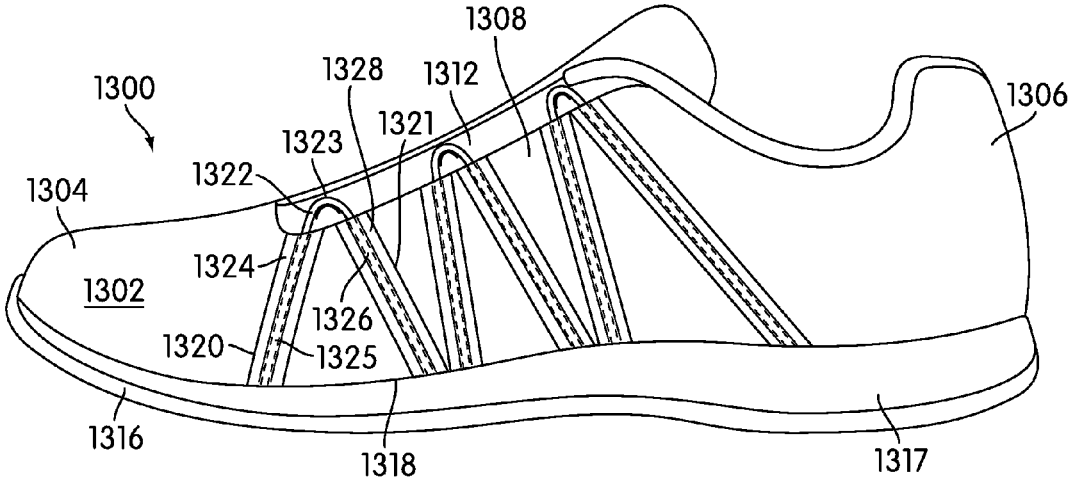
FIG. 17 is a side view of an embodiment of an article of footwear incorporating tendons, wherein the placement of the tendons within their respective assemblies is shown.
Figure 18:
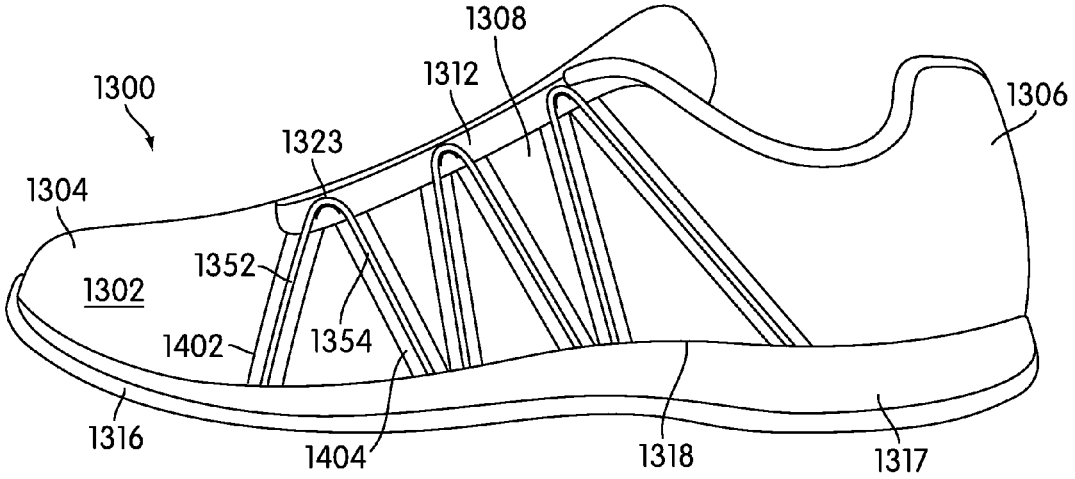
FIG. 18 is a side view of an embodiment of an article of footwear incorporating tendons, wherein the cover layer of the tendon assemblies has been removed.

FIG. 17 depicts a side view of an article of footwear 1300 according to another embodiment, wherein the placement of tendons 1322 are depicted as phantom lines 1326 within their respective tendon assemblies 1320. FIG. 18 depicts a side view of article 1300 according to an embodiment described herein, wherein cover layers 1324 of tendon assemblies 1320 have been removed, revealing tendons 1322. Again, for simplicity, only exemplary tendon assemblies 1320 and 1321 shown in FIGS. 17 and 18 have been labeled. The embodiment of article 1300 is similar to the embodiment of footwear depicted and discussed in the foregoing FIGS. 1-2, 5-7, and 12-13 in that article 1300 includes an upper 1302 attached to a sole 1316. As depicted in FIG. 17, article 1300 and sole 1316 may also include a midsole 1317. Midsole 1317 may be attached to upper 1302 at lasting margin 1318, but those skilled in the art will recognize that article 1300 may be constructed without a midsole 1317 or may be constructed with additional layers between upper 1302 and sole 1316. Upper 1302 may further be referred to as having a toe end 1304, an ankle/heel end 1306 and a mid-step region 1308. Upper 1302 may also include fastening region 1312, which may be a separate piece attached by known means to upper 1302 or may be integrated with upper 1302.

According to the embodiment depicted in FIG. 17, tendon 1322 (shown the length of tendon assemblies 1320 and 1321 with phantom lines 1325 and 1326, respectively) may be positioned under cover layer 1324 and cover layer 1328 and run from lasting margin 1318 to fastening region 1312 and back to lasting margin 918 to form loop 923 in fastening region 912. As can be seen in the embodiment of FIGS. 17-18, each tendon 1322 may be looped (loop 1323) at fastening region 1312 such that each tendon 1322 forms two strands 1352 and 1354. Furthermore, according to the embodiment, strand 1352 and strand 1354 may be configured to engage a fastening system such as a shoe lace, as discussed previously. The ends of tendons strands 1352 and 1354 may be rigidly attached under upper as discussed in relation to FIG. 7, above. According to aspects described herein, tendons 1322 (i.e. each tendon strand 1352 and 1354) may be freely movable within tendon assembly 920, as discussed above, such that engagement by a fastening system at loop 1323 could allow tendon 1322 to pull against the rigid attachment of tendon 1322 at lasting margin 1318 and to tighten, pulling upper 1302 closer and more snugly to a wearer's foot and providing support to a wearer's foot.

Figure 19:
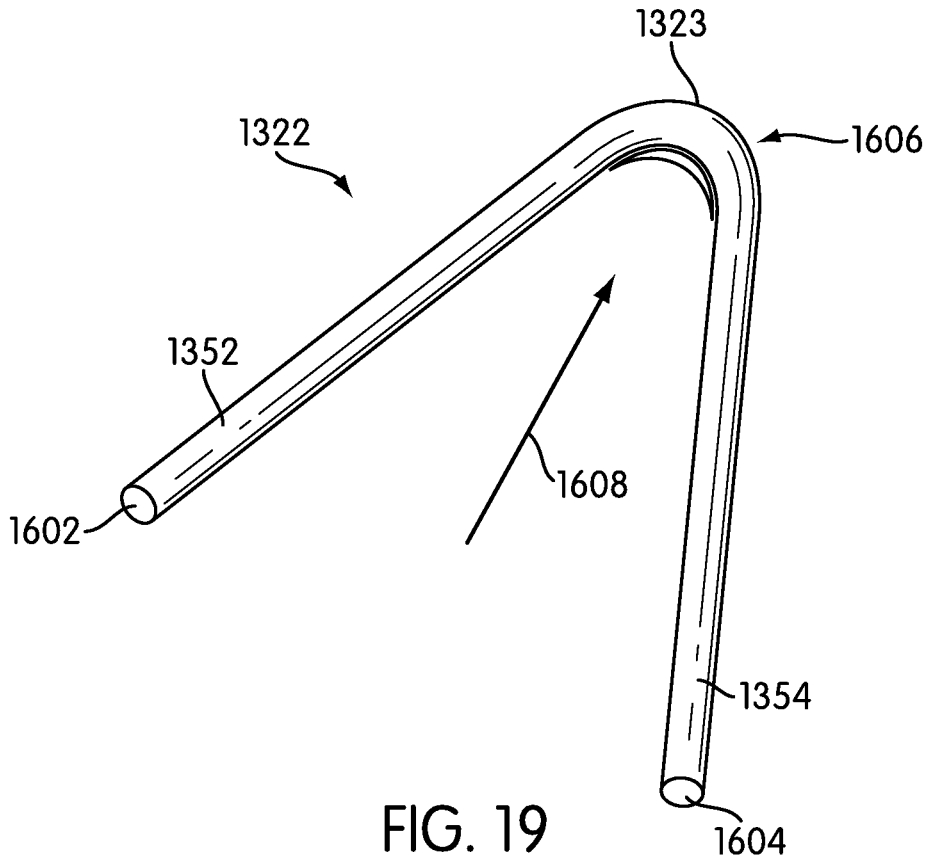
FIG. 19 is an embodiment of a tendon.

FIG. 19 depicts a tendon 1322 according to the embodiment depicted in FIGS. 17-18. As previously described, tendon 1322 may be looped (at loop 1323) to form two strands, strand 1352 and strand 1354. The ends of strand 1352 and strand 1354 may create end 1602 and end 1604, respectively. Tendon 1322 may thus form loop 1323 at opposite end 1606. The ends of strand 1322 may be rigidly secured or attached at end 1602 and end 1604 at or near the lasting margin of an article of footwear. The opposite end 1606 may be configured to engage with a fastening system.

In the embodiment depicted in FIG. 19, end 1606 may be secured in a loop 1323 to engage with a means for fastening an article of footwear such as a shoelace, or any other means contemplated by a skilled artisan. A shoelace (not shown in FIG. 19) may be threaded through loop 1323 to pull tendon 1322 in direction 1608, as described in more detail below. In some embodiments, to prevent abrasion to tendon 1322 by a fastening system, loop 1323 of tendon 1322 may be reinforced with element 1610 or by any other means known to a skilled artisan. Thus, according to aspects described herein, tendon 1322 may be freely movable within tendon assemblies 1320 and 1321 (shown in FIG. 13), as discussed above, such that engagement by a fastening system at loop 1323 would allow tendon strand 1352 and strand 1354 to pull against their rigid attachment points at end 1602 and end 1604, respectively, and to tighten, pulling upper 1302 closer and more snugly to a wearer's foot and providing support to a wearer's foot.

Figure 20:
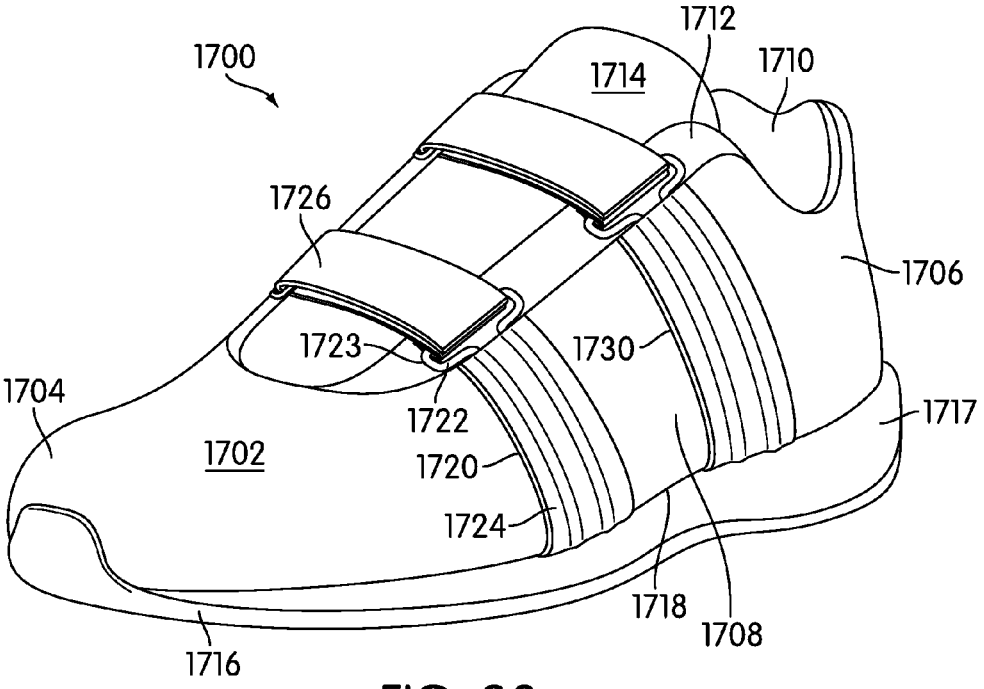
FIG. 20 is a side perspective view of an embodiment of an article of footwear incorporating tendons.
Figure 21:
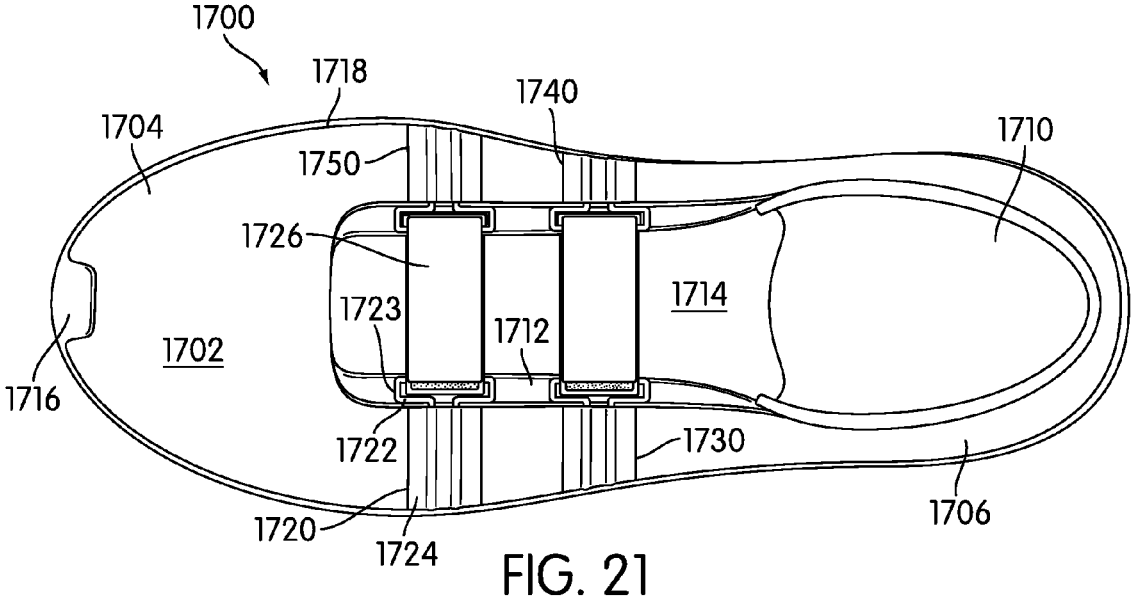
FIG. 21 is a top view of an embodiment of an article of footwear incorporating tendons.

FIG. 20 depicts a lateral side perspective view of an article of footwear 1700 incorporating tendons according to an additional embodiment described herein. FIG. 21 depicts a top view of the same article 1700. Similar to previous embodiments described herein, article 1700 may incorporate provisions that are useful in athletic- or sports-related activities, but may be equally applicable in a variety of contexts or non-sports-related activities. These provisions include features such as a lightweight upper and overall structure combined with increased support to the foot. These and other features of certain embodiments of article 1700 are discussed in more detail below.

As seen in FIGS. 20-21, shoe 1700 includes upper 1702. Upper 1702 further includes an opening 1710 at the heel/ankle end 1706 for inserting a wearer's foot into article 1700, and a fastening region 1712. As with previously discussed embodiments, opening 1710 may be limited to the heel/ankle area 1706 of article 1700 or may extend along the top of upper 1702 into, and include, fastening region 1712. Thus, in one embodiment of article 1700, upper 1702 may be integrated with fastening region 1712, and in another embodiment fastening region 1712 may be separately affixed to upper 1702. Fastening region 1712 may be situated along the mid-step region 1708 of upper 1702 as shown in FIGS. 17-18, or may be situated at other parts of article 1700, as would be apparent to those of skill in the art.

Fastening region 1712 may include a fastening system for tightening article 1700 around a wearer's foot, as discussed in more detail below. Examples of different fastening systems that could be used with fastening region 1712 include, but are not limited to: lacing systems, strap systems, as well as any other kind of systems. Thus, fastening region may be configured in a variety of ways to accommodate different types of fastening systems.

Upper 1702 may further include a separate provision, such as tongue 1714, which may be attached to upper 1702 under fastening region 1712. In some cases, tongue 1714 may be rigidly attached only at the toe end 1704 of upper 1702. In other cases, tongue 1714 may be additionally rigidly attached along a portion of the fastening region 1712. In still other cases, tongue 1714 may be attached at the toe end 1704 and along the entirety of fastening region 1712. Depending on how tongue 1714 is attached to upper 1702, opening 1710 may be of varying sizes when tongue 1714 is lifted up from fastening region 1712.

Article 1700 and upper 1702 may be constructed of any lightweight and breathable material, such as a woven nylon, polyester or other woven fiber. Upper 1702 may also be made of a water durable material such as neoprene or other similar material. However, those skilled in the art will readily appreciate the array of materials that may be used for upper 1702 and, as such, will recognize that the previously listed materials are for exemplary purposes only.

Article 1700 may further include a sole 1716, including midsole 1717 which may be attached to upper 1702 along lasting margin 1718. Those of skill in the art will recognize that there may be additional layer(s) between upper 1702 and sole 1716, such as an additional midsole or other padding layer. Skilled artisans will also recognize that article 1700 may not include midsole 1717 and yet still include certain provisions described herein. Moreover, in some cases, sole 1716 could include an outsole that is disposed on a lower side of midsole 1717.

Sole 1716, midsole 1717 and upper 1702 may be attached by any means known in the art such as by stitching, cement or by use of another adhesive material. Midsole 1717 may be constructed from a molded, padded material, as known in the art. Sole 1716 may also be constructed from a molded padded material, or other durable material known in the art. In some embodiments, sole 1716 may further include provisions on the bottom for traction, such as a non-skid or non-slip surface, cleats, or other similar features. In some cases, these provisions could be associated with an outsole of sole 1716.

According to an embodiment described herein, article 1700 may also include provisions for added support and stability on upper 1702, such as tendon assembly 1720, tendon assembly 1730, tendon assembly 1740 and tendon assembly 1750. For simplicity only tendon assembly 1720, shown in FIGS. 20-21, has been labeled in detail. Tendon assembly 1730, tendon assembly 1740 and tendon assembly 1750 are similar to tendon assembly 1720 and may be considered to contain similar provisions and features as tendon assembly 1720. According to aspects described herein, one or more tendons 1722 may be provided between a base layer (as previously discussed) and a separate top/cover layer 1724 to form tendon strand assembly 1720. As described above in various embodiments, tendon 1722 may form a loop 1723 and protrude slightly from tendon assembly 1720 at the top of the assembly in fastening region 1712. Thus, tendon 1722 may be integrated with a fastening system (e.g. hook and eye fastener 1726) to provide added support to upper 1702.

Figure 22:
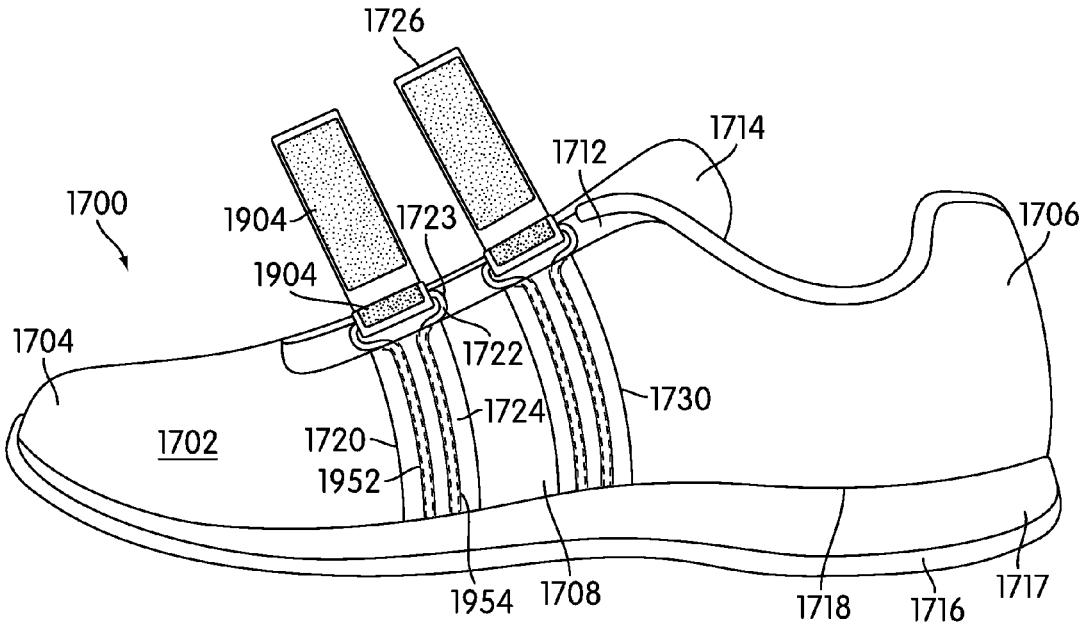
FIG. 22 is a lateral side view of an embodiment of an article of footwear incorporating tendons, wherein the placement of the tendons within their respective assemblies is shown.
Figure 23:
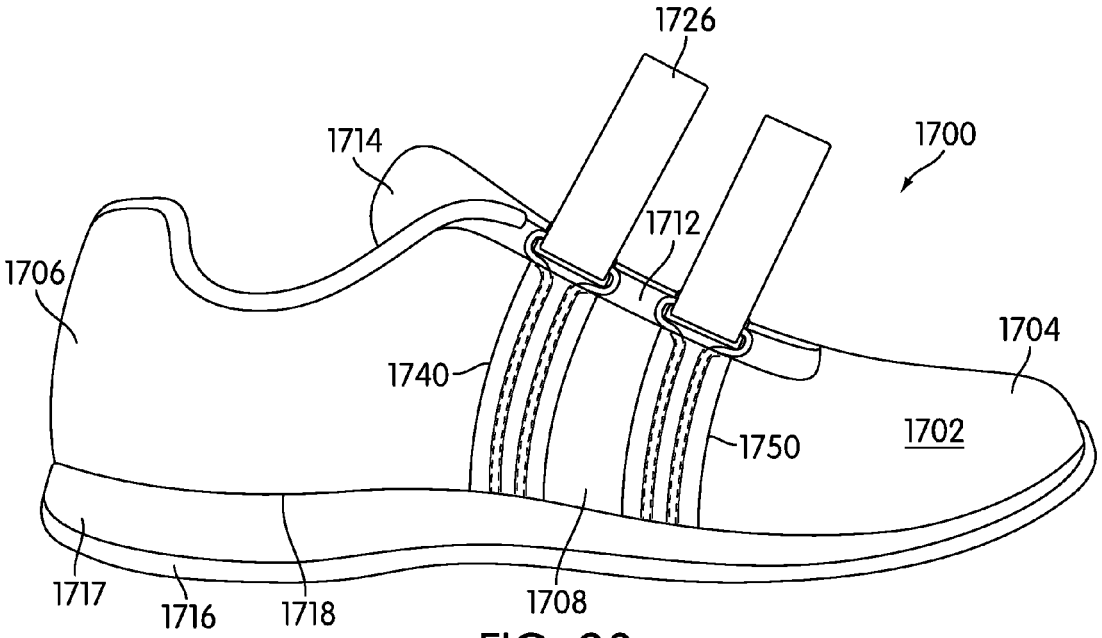
FIG. 23 is a medial side view of an embodiment of an article of footwear incorporating tendons, wherein the placement of the tendons within their respective assemblies is shown.

FIGS. 22 and 23 depict lateral and medial side views, respectively, of article 1700 incorporating tendon 1722 according to an embodiment described herein. The placement of tendon 1722 within the respective assembly 1720 is shown in phantom. As can be appreciated by reference to the embodiment depicted in FIGS. 22-23, tendon 1722 and tendon assembly 1720 may be similar to the embodiment set forth above in relation to FIGS. 12-16, in that tendon 1722 is looped to form strand 1952 and strand 1954 two strands (depicted with phantom line 1952 and line 1954) within a single tendon assembly.

According to the embodiment depicted in FIGS. 22-23, tendon 1722 may be positioned under cover layer 1724 and run from lasting margin 1718 to fastening region 1712 and back to lasting margin 1718 to form loop 1723 in fastening region 1712. Loop 1723 may be configured to engage a fastening system such as a fastener 1726 with hook and eye closures 1904. The ends of tendons 1722 may be rigidly attached under upper as discussed in relation to FIG. 7, above. Furthermore, according to aspects described herein, the tendon strands of tendon 1722 (depicted by phantom lines 1952 and 1954) may be freely movable within tendon assembly 1720, as discussed above, such that engagement by a fastening system at loop 1723 could allow a tendon 1722 to pull against the rigid attachment of tendon 1922 at both ends at lasting margin 1718 and to tighten, pulling upper 1702 closer and more snugly to a wearer's foot and providing support to a wearer's foot.

Figure 24:
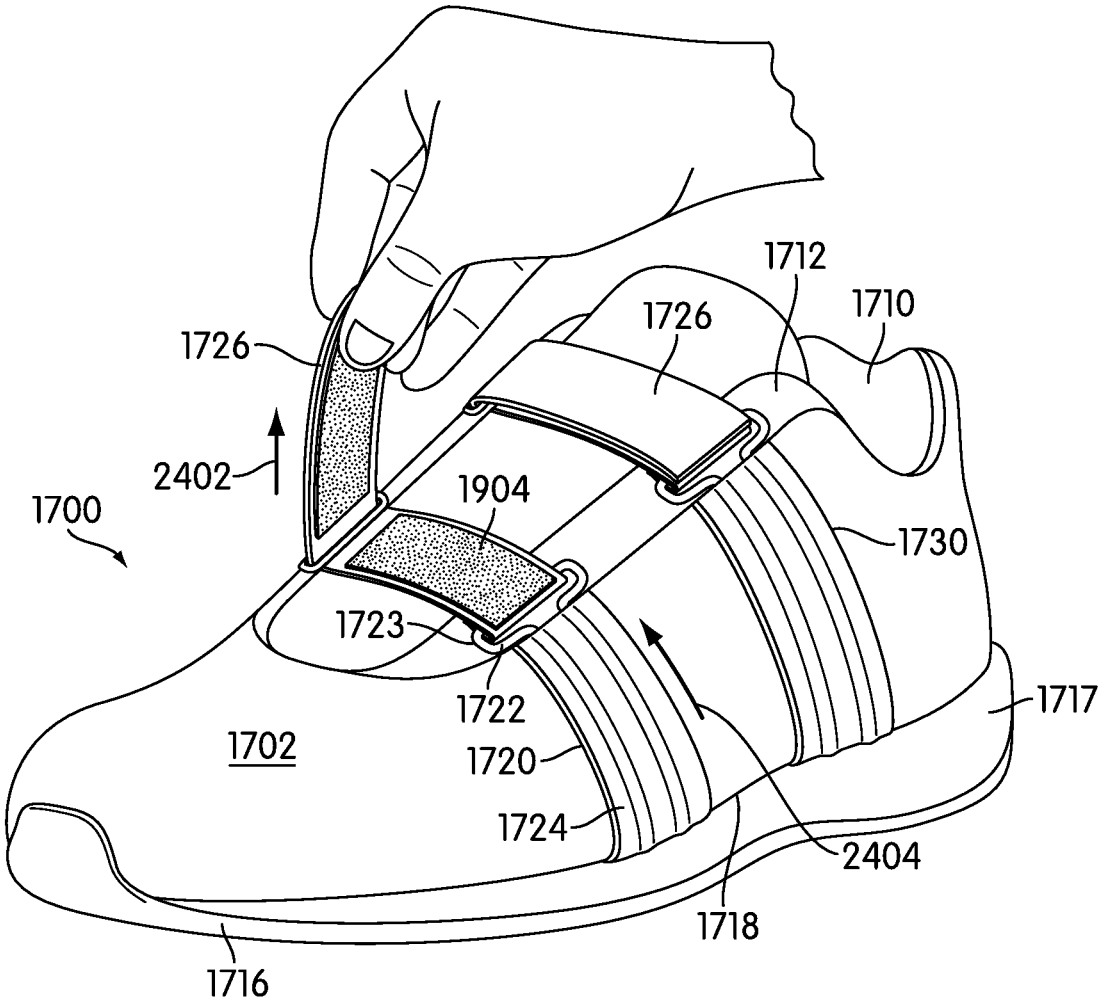
FIG. 24 is a side perspective view of an embodiment of an article of footwear with fastening system incorporating tendons, wherein the placement of the tendons within their respective assemblies is shown.

FIG. 24 depicts an additional embodiment of an article of footwear described herein, e.g. article 1700, which may include provisions for added support and stability on upper 1702, such as tendon assemblies 1720 and 1730 (tendon assemblies 1740 and 1750 not shown in FIG. 24), as described above. FIG. 24 depicts a side perspective view of article 1700 with fastening system 1726 engaging tendons, e.g. tendon 1722, at loop 1723 for added support and stability. Fastening system 1726 may include straps 1726 with hook and eye closures 1904 or any other type of other fastening system, as known in the art. As depicted in FIG. 24, a wearer may insert a foot in opening 1710 of article 1700 and pull on straps 1726 in direction 2402 to tighten article 1700 around the foot. Straps 1726 may be engaged with tendons, e.g. tendon 1722, at loop 1723 such that as the wearer pulls in direction 2402, tendons 1722 may be pulled in a direction towards the wearer's foot, e.g. direction 2404, effectively pulling upper 1702 more snugly against the wearer's foot.

Figure 25:
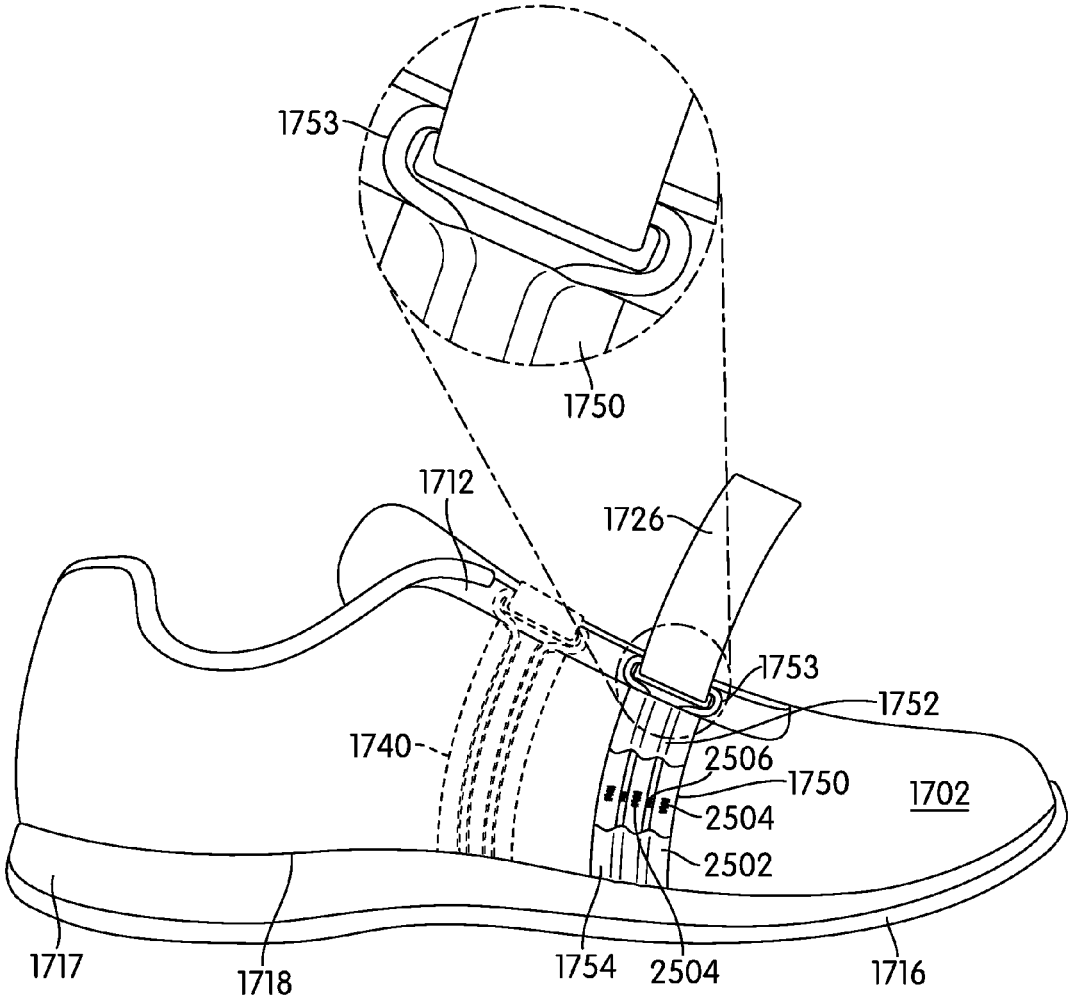
FIG. 25 is a side view of an embodiment of an article of footwear incorporating tendons, wherein the cover layer of the tendon assemblies has been partially removed to show placement of the tendons before a fastening system is tightened.
Figure 26:
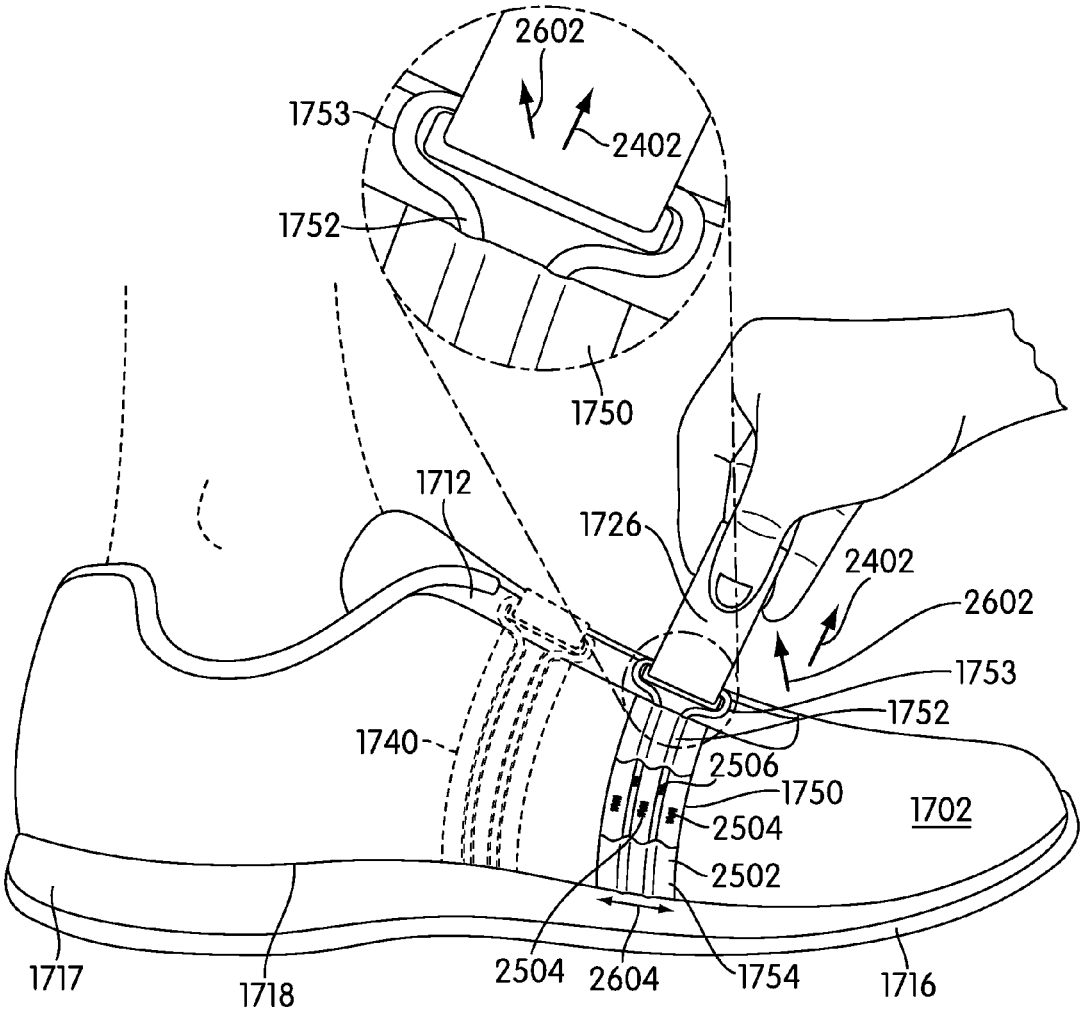
FIG. 26 is a side view of an embodiment of an article of footwear incorporating tendons, wherein the cover layer of the tendon assemblies has been partially removed to show movement of the tendons after a fastening system is tightened.

FIGS. 25 and 26 depict a medial side view of article 1700, wherein cover 1754 of one tendon assembly 1750 has been removed to show how tendon 1752 may freely move between top/cover layer 1754 and base layer 2502. For simplicity, the remaining tendon assembly 1740 in view on article 1700 in FIGS. 25 and 26 is shown in phantom and not labeled.

As has been previously described with respect to similar tendon 1722, tendon 1752 may be configured to freely move within tendon assembly 1750. Marks 2504 and mark 2506, shown in FIGS. 25 and 26, depict the movement of tendon 1752 according to an embodiment set forth herein. Marks 2504 are applied to base layer 2502 and mark 2506 is applied to tendon 1752. It will be understood that marks 2504 and mark 2206 are only shown for purposes of illustrating the movement of tendon 1752 within tendon assembly 1750. In a normal position (i.e. no tension being applied to straps 1726), tendon 1752 may rest at the position shown in FIG. 25, wherein marks 2504 and 2506 line up across tendon assembly 1750. As tension is applied to straps 1726 in direction 2402, tendon 1752 may be pulled at loop 1753, against attachment points at lasting margin 1718, to hug the wearer's foot and pull upper 1702 against wearer's foot. As can be seen in FIG. 26, the tightening of a fastening system may cause tendon 1752 to move within tendon assembly 1750, and more particularly, to move up in direction 2402, as well as in direction 2602 towards the arch of wearer's foot, to tighten upper 1702 around the wearer's foot, providing additional support to wearer's foot. The movement of tendon 1752 is shown by the shifted position of marks 2506 with respect to marks 2504, which remain stable on upper 1702. Those of skill in the art will recognize that the movement of tendon 1752 depicted in FIGS. 25 and 26 is for exemplary purposes only, and that tendon 1752 may move more or less than depicted, and may also move slightly in a lateral direction 2604 within tendon assembly 1750 when tension is applied.

Figure 27:
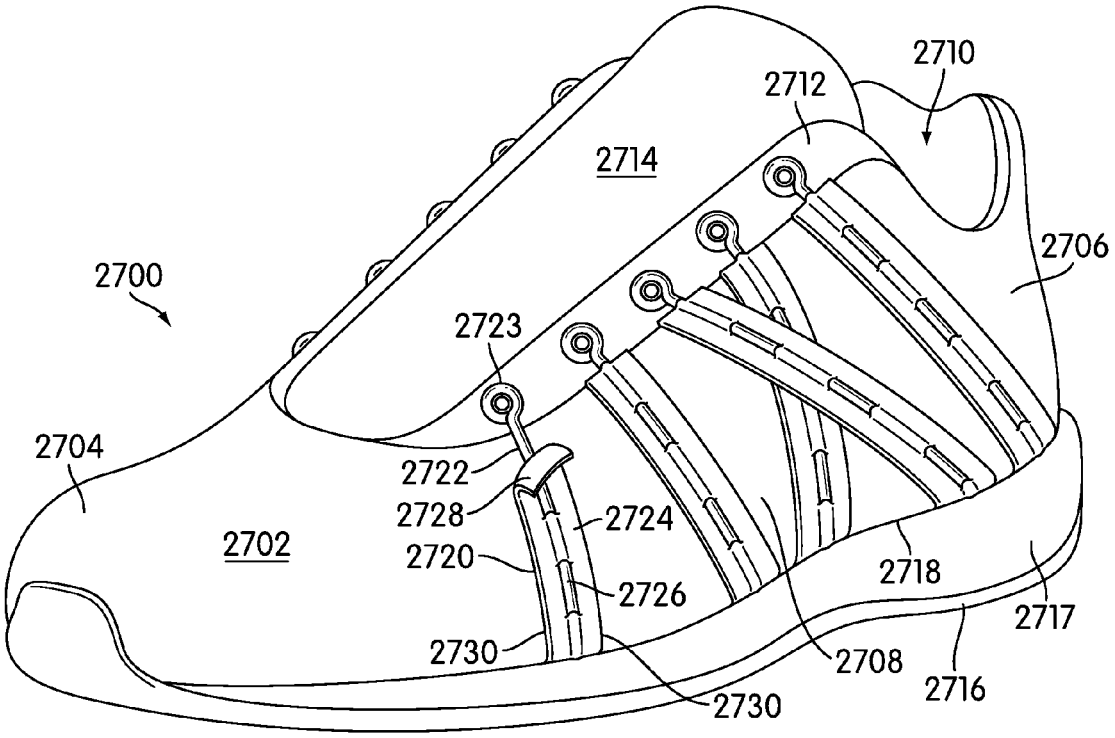
FIG. 27 is a side perspective view of an embodiment of an article of footwear incorporating a tendon assembly.

It shall be further understood that tendon assemblies as described herein may be embodied and secured in a variety of ways and still fall within the spirit and scope of the present disclosure. FIG. 27 depicts a side perspective view of an article 2700 incorporating tendon assemblies according to an additional embodiment described herein. For simplicity, only one of multiple tendon assemblies 2720 shown in FIG. 27 has been labeled. The embodiment of article 2700 is similar to the embodiment of footwear depicted and discussed in the foregoing FIGS. in that article 2700 includes an upper 2702 attached to a sole 2716. As depicted in FIG. 27, sole 2716 may also include a midsole 2717. Midsole 2717 may be attached to upper 2702 at lasting margin 2718, but those skilled in the art will recognize that article 2700 may be constructed without a midsole 2717 or may be constructed with additional layers between upper 2702 and sole 2716. Upper 2702 may further be referred to as having a toe end 2704, an ankle/heel end 2706 and a mid-step region 2708. Upper 2702 may also include fastening region 2712, which may be a separate piece attached by known means to upper 2702 or may be constructed from upper 2702.

According to the embodiment depicted in FIG. 27, tendons 2722 (shown the length of tendon assembly 2720) may be positioned under cover layer 2724 and run from lasting margin 2718 to fastening region 2712, forming a loop 2723 in fastening region 2712. Loop 2723 may be configured to engage a fastening system such as a shoe lace, as discussed previously. As contemplated herein, one end of tendon 2722 may be rigidly attached under upper 2702 as discussed in relation to FIG. 7, above. Furthermore, according to aspects described herein, tendon 2722 may be freely movable within tendon assembly 2720, as discussed above, such that engagement by a fastening system at loop 2723 could allow a tendon 2722 to pull against the rigid attachment of tendon 2722 at lasting margin 2718 and to tighten, pulling upper 2702 closer and more snugly to a wearer's foot and providing support to a wearer's foot.

According to the embodiment of FIG. 27, tendon assembly 2720 may consist of cover layer 2724, tendon 2722 and upper 2702. Thus, the base layer of tendon assembly 2720 may comprise upper 2702. Cover layer 2724 of tendon assembly 2720 is pulled back at 2728 to reveal tendon 2722 positioned on upper 2702. Top/cover layer 2724 may be rigidly attached to upper 2702 along edges 2730, running from lasting margin 2718 to fastening region 2712, by any known means, such as by adhesive, stitching or weaving. Furthermore, according to aspects set forth herein, cover layer 2724 may have openings 2726 revealing tendon 2722.

Tendon assemblies 2720 of article 2700 may provide added support and stability to upper 2720 when engaged with a fastening system at loop 2723, such as described above with respect to prior embodiments. Thus, a wearer may insert a foot in opening 2710 of article 2700 and pull on a fastening system (such as laces, not shown) to tighten article 2700 around the foot. A fastening system may be engaged with tendons 2722 at loops 2723 such that as the wearer pulls on the fastening system, tendons 2722 may be pulled in a direction towards the wearer's foot, effectively pulling upper 2702 more snugly against the wearer's foot.

While various embodiments have been described herein, the description is intended to be exemplary, rather than limiting and it will be apparent to those of ordinary skill in the art that many more embodiments and implementations are possible that are within the scope of the present disclosure. Accordingly, the invention is not to be restricted except in light of the attached claims and their equivalents. Also, various modifications and changes may be made within the scope of the attached claims.

What is claimed is:

1. An article of footwear comprising:

an upper, the upper connected to a fastening region and wherein the upper includes an opening;

a sole attached to the upper;

a fastening system proximate the fastening region, wherein at least a portion of the opening is adjustable by the fastening system; and a tendon assembly secured to the upper between the sole and the fastening region, the tendon assembly having a longitudinal direction directed along the length of the tendon assembly and a lateral direction perpendicular to the longitudinal direction, wherein the tendon assembly comprises:

a base layer secured to the upper, the base layer extending from a lasting margin to the fastening region;

a separate top layer connected to the base layer, the top layer extending from the lasting margin to the fastening region;

a tendon positioned between the base layer and the top layer such that the tendon moves freely between the base layer and the top layer in both the longitudinal direction and the lateral direction;

wherein the base layer and the top layer each comprise a strip that extends parallel to the tendon along the length of the tendon assembly; and wherein the tendon is configured to move with the fastening system and shift with respect to the base layer and the top layer.

2. The article of footwear according to claim 1, wherein the sole and upper are joined at the lasting margin and the tendon is secured at the lasting margin.

3. The article of footwear according to claim 2, wherein the tendon extends into the fastening region.

4. The article of footwear according to claim 3, wherein the tendon forms a loop for engaging a fastening system in the fastening region.

5. The article of footwear according to claim 4, wherein both ends of the tendon are secured at the lasting margin and the midpoint of the tendon forms a loop for engaging a fastening system in the fastening region.

6. The article of footwear according to claim 4 wherein the fastening system comprises laces.

7. The article of footwear according to claim 1, wherein the fastening system comprises hook and eye closures.

8. The article of footwear according to claim 1, wherein the tendon assembly is positioned on a medial side of the upper.

9. The article of footwear according to claim 1, wherein the tendon assembly is positioned on a lateral side of the upper.

10. The article of footwear according to claim 1, further comprising multiple tendon assemblies on the upper.

11. The article of footwear according to claim 1, wherein the top layer further comprises a channel for placement of the tendon.

12. A tendon assembly configured for placement on an upper of an article of footwear comprising:

a base layer for securing to the upper;

a separate upper layer configured to attach to the base layer and extending along a length of the base layer, wherein the base layer and the upper layer together define a space that extends along a length of the tendon assembly, the length of the tendon assembly extending from an area of the upper near a sole of the article to an area of the upper near a fastening system of the article; and a tendon positioned in the space, wherein the tendon is configured to move freely within the space in both a longitudinal direction directed along the length of the tendon assembly and a lateral direction perpendicular to the longitudinal direction, and wherein the tendon may be integrated with a fastening system on the article of footwear such that the tendon is configured to move with the fastening system and shift with respect to the base layer and the top layer.

13. The tendon assembly of claim 12, wherein the space comprises a channel in the cover layer.

14. The tendon assembly of claim 12, wherein the upper layer is configured to partially expose the tendon.

15. An article of footwear comprising:

an upper, wherein the upper includes a fastening region with a fastening system;

a sole attached to the upper; and a tendon assembly attached to the upper and extending from an area proximate the sole to an area proximate the fastening region, the tendon assembly having a longitudinal direction directed along the length of the tendon assembly and a lateral direction perpendicular to the longitudinal direction, wherein the tendon assembly comprises:

a base layer secured to the upper, the base layer extending from the area proximate the sole to the area proximate the fastening region;

a separate top layer attached to the base layer, the top layer extending from the area proximate the sole to the area proximate the fastening region, wherein the top layer is configured to substantially cover the base layer; and a tendon positioned between the base layer and the top layer such that the tendon moves freely between the base layer and the top layer in both the longitudinal direction and the lateral direction, and wherein the tendon is configured to engage with the fastening system and move with respect to the base layer and the top layer.

16. The article of footwear according to claim 15, wherein the sole and upper are joined at a lasting margin and the tendon assembly is rigidly secured at the lasting margin.

17. The article of footwear according to claim 16, wherein both ends of the tendon are secured at the lasting margin and the midpoint of the tendon forms a loop for engaging a fastening system in the fastening region.

18. The article of footwear according to claim 15, wherein the tendon forms a loop for engaging a fastening system in the fastening region.

19. The article of footwear according to claim 18 wherein the fastening system comprises laces.

20. The article of footwear according to claim 18, wherein the fastening system comprises hook and eye closures.

* * * * *